US007053289B2

(12) United States Patent
Iwai et al.

(10) Patent No.: US 7,053,289 B2
(45) Date of Patent: May 30, 2006

(54) MOVING APPARATUS AND MOVING APPARATUS SYSTEM

(75) Inventors: Toshio Iwai, Mitaka (JP); Nobuo Hara, Fukuroi (JP); Masanori Negoro, Shizuoka-ken (JP); Yasuhiko Asahi, Iwata (JP)

(73) Assignees: Yamaha Corporation (JP); Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 11/041,720

(22) Filed: Jan. 24, 2005

(65) Prior Publication Data

US 2005/0160902 A1 Jul. 28, 2005

(30) Foreign Application Priority Data

Jan. 23, 2004 (JP) ..... 2004-015201

(51) Int. Cl.
*G10H 7/00* (2006.01)

(52) U.S. Cl. ..... 84/600; 455/344; 280/87.042

(58) Field of Classification Search ..... 84/600; 455/344; 280/87.042, 288.4
See application file for complete search history.

(56) References Cited

U.S. PATENT DOCUMENTS

| | | | | |
|---|---|---|---|---|
| 4,043,241 | A | 8/1977 | Liu | |
| 4,270,764 | A * | 6/1981 | Yamada | 280/87.042 |
| 4,824,139 | A * | 4/1989 | Robbins | 280/816 |
| 5,004,256 | A * | 4/1991 | Won | 280/87.042 |
| 5,029,661 | A * | 7/1991 | Wallace et al. | 180/165 |
| 5,130,693 | A * | 7/1992 | Gigandet | 340/815.69 |
| D355,946 | S * | 2/1995 | Park | D21/765 |
| 5,737,247 | A * | 4/1998 | Baer et al. | 702/149 |
| 6,050,357 | A * | 4/2000 | Staelin et al. | 180/65.1 |
| 2003/0076968 | A1 * | 4/2003 | Rast | 381/124 |
| 2004/0170288 | A1 | 9/2004 | Maeda | |

FOREIGN PATENT DOCUMENTS

JP 2970494 B 8/1999

OTHER PUBLICATIONS

U.S. Appl. No. 11/041,599, Iwai et al., rel. co-pending app.

* cited by examiner

*Primary Examiner*—Jeffrey W Donels
(74) *Attorney, Agent, or Firm*—Rossi, Kimms & McDowell, LLP

(57) ABSTRACT

A skateboard SB has a board 10 that is rotatably provided with a front wheel 25 and rear wheel 26. Disposed on the both sides of the board 10 are speakers 12*a*, 12*b*. On the undersurface of the board 10 there are provided a floor sensor 66 having a CCD camera for shooting a floor and a distance sensor 67 for sensing the distance to the floor. A control box 13 disposed on the undersurface of the board 10 is equipped with a computer device and a tone generator. The computer device controls, in accordance with the color and lightness of the floor sensed by the floor sensor 66 and the distance sensed by the distance sensor 67, the generation of musical tone signals by the tone generator and the mode in which the musical tone signals are generated. A moving apparatus constructed as described above enables a player to listen to music that corresponds to changes in external conditions where the moving apparatus is placed, bringing more fun to the player without making the player tired.

20 Claims, 18 Drawing Sheets

MOVING APPARATUS AND MOVING APPARATUS SYSTEM

BACKGROUND OF THE INVENTION

1. Field of the Invention

The present invention relates to a moving apparatus which a human being can ride to move by motor-power or human-power and a system for the moving apparatus.

2. Description of the Related Art

Conventionally, many people enjoy riding a moving apparatus such as a skateboard while listening to music emitted from a radio, tape recorder or the like. Furthermore, in JP2970494B, for example, there is disclosed a musical apparatus, a player of which wears controllers on his/her hands and shoulders for sensing the movements of his/her hands and shoulders, and has a plurality of pressure sensors in his/her shoes. The musical apparatus is designed to control musical tones to be generated in accordance with the movements of his/her hands and shoulders sensed by the controllers and stepping forces sensed by the pressure sensors. With this musical apparatus, the player can play music by moving his/her hands and feet.

However, in the former related art, in which music is completely separated from the moving apparatus, people merely ride on the moving apparatus to move while listening to music. In the latter related art, furthermore, the player needs to focus on his/her performance, missing an opportunity to enjoy additional fun such as sporting taste and entertainment value.

SUMMARY OF THE INVENTION

The present invention was accomplished to solve the above-described problems, and an object thereof is to provide a moving apparatus and moving apparatus system which bring more fun to a player without making the player tired by enabling the player to listen to music that corresponds to external conditions in which the moving apparatus is placed and which vary with the travel of the moving apparatus.

In order to achieve the above-described object, a feature of the present invention lies in a moving apparatus which a human can ride to move, the moving apparatus comprising a musical tone signal generating portion for generating a musical tone signal, an external condition sensing portion for sensing external conditions in which the moving apparatus is placed and which vary with the travel of the moving apparatus, and a generation mode controlling portion for controlling a mode in which the musical tone signal is generated by the musical tone signal generating portion in accordance with the sensed external conditions. The moving apparatus moves by motor-power or human-power.

Another feature of the present invention lies in a moving apparatus system having a moving apparatus which a human can ride to move and an electronic musical apparatus which is disposed apart from the moving apparatus and includes a musical tone signal generating portion for generating a musical tone signal, wherein the moving apparatus is provided with an external condition sensing portion for sensing external conditions in which the moving apparatus is placed and which vary with the travel of the moving apparatus and a transmitting portion for transmitting a signal indicative of the sensed external conditions, and the electronic musical apparatus is provided with a generation mode controlling portion for receiving the signal transmitted from the transmitting portion and controlling, on the basis of the received signal, a mode in which the musical tone signal is generated by the musical tone signal generating portion in accordance with the sensed external conditions. The moving apparatus moves by motor-power or human-power.

In these cases, for example, the moving apparatus travels on a floor, and the external conditions indicate a state of the floor on which the moving apparatus travels. The state of the floor includes, for instance, the lightness (light and shade) of the floor, the color of the floor, the pattern of the floor, and projections and depressions of the floor. The concept of the floor widely includes various locations where the moving apparatus can travel such as outdoor surfaces constructed of concrete, tiles, stones or the like, indoor floors and stages. The moving apparatus may be adapted to travel by human operation, shifting of weight or the like. Moreover, the moving apparatus may have any moving means such as a moving apparatus that travels by rotation of tires or a moving apparatus that travels by jumping through the use of rebound of springs.

Furthermore, the musical tone signal generating portion may automatically generate a series of musical tone signals on the basis of a series of performance data, and the generation mode controlling portion may change a mode in which the series of musical tone signals are generated in accordance with the sensed external conditions. In this case, the mode to be changed includes the tempo of performance in which the series of musical tone signals are automatically generated, in other words, the tempo of automatic performance (automatic performance such as melody, accompaniment and rhythm), the timing at which a musical tone signal is generated, and the switching of performance data (melody, accompaniment and rhythm) formed of a series of performance data. Moreover, the generation mode controlling portion may control, on the basis of the sensed external conditions, a timing at which the musical tone signal generating portion generates a musical tone signal or a musical tone element of the musical tone signal generated by the musical tone signal generating portion. In this case, the musical tone element includes the tone pitch, tone color and volume (amplitude envelope) of a musical tone signal as well as an effect to be added to the musical tone signal.

Furthermore, the moving apparatus further includes a movement amount sensing portion for sensing the amount of movement indicative of the movement of the moving apparatus, and the generation mode controlling portion controls the mode in which a musical tone signal is generated by the musical tone signal generating portion in accordance with the sensed amount of the movement in addition to the sensed external conditions. In this case as well, for example, the movement of the moving apparatus is brought by human operation, shifting of weight or the like. The amount of movement of the moving apparatus includes a steering angle, forward and backward acceleration and lateral acceleration, forward and backward speed and lateral speed, traveling direction, and angle speed of the moving apparatus. In the case of a moving apparatus that travels by jumping through the use of rebound of springs, the amount of movement may include vertical acceleration and speed, and impact from the floor.

According to the present invention, when a player rides the moving apparatus to move, the external condition sensing portion senses external conditions that vary with the travel of the moving apparatus, so that the generation mode controlling portion variously controls the mode in which musical tone signals are generated in accordance with the external conditions. As a result, the player can travel with the moving apparatus while listening to music that varies with the travel of the moving apparatus. Therefore, the present invention brings more fun to the player without making the player tired. In addition, the present invention also enables the player to play music by changing the mode in which the player operates the moving apparatus.

BRIEF DESCRIPTION OF THE DRAWINGS

FIG. 11(A) is a schematic sketch in which a player riding the skateboard is viewed from the front, while FIG. 11(B) is a schematic sketch in which the player is viewed from the left;

DESCRIPTION OF THE PREFERRED EMBODIMENT a. First Embodiment

Figure 1:
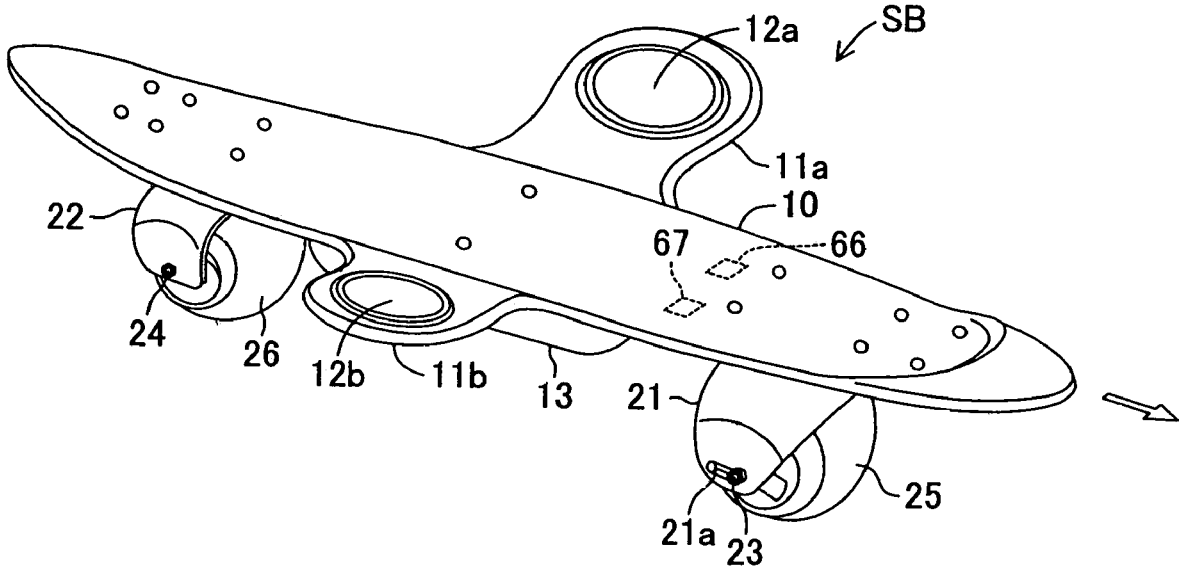
FIG. 1 is a perspective view showing the whole of a skateboard according to a first embodiment of the present invention.

A first embodiment of the present invention will now be described with reference to the drawings. FIG. 1 is a perspective view of a skateboard SB shown as an example of a moving apparatus of the present invention.

The skateboard SB has a plate-shaped board 10 having a long length in the front and rear direction. The skateboard SB is formed of a hard material such as lumber or synthetic resin (e.g., FRP). In FIG. 1 and later-discussed FIG. 2, the skateboard moves in the direction (rightward) shown by an arrow. At the right and left sides of the midsection in the front and rear direction of the board 10, integrally formed with the board 10 are a plate-shaped pair of projections 11*a*, 11*b* extending from the board 10 diagonally upward to the right and left. The projections 11*a*, 11*b* are provided with speakers 12*a*, 12*b*, respectively, in order to emit tones upward. Although the speakers 12*a*, 12*b* may have low directivity, the speakers 12*a*, 12*b* with high directivity are preferable. On the undersurface of the midsection in the front and rear direction of the board 10 there is provided a control box 13 for controlling the driving of the skateboard SB and generation of musical tones.

Figure 2:
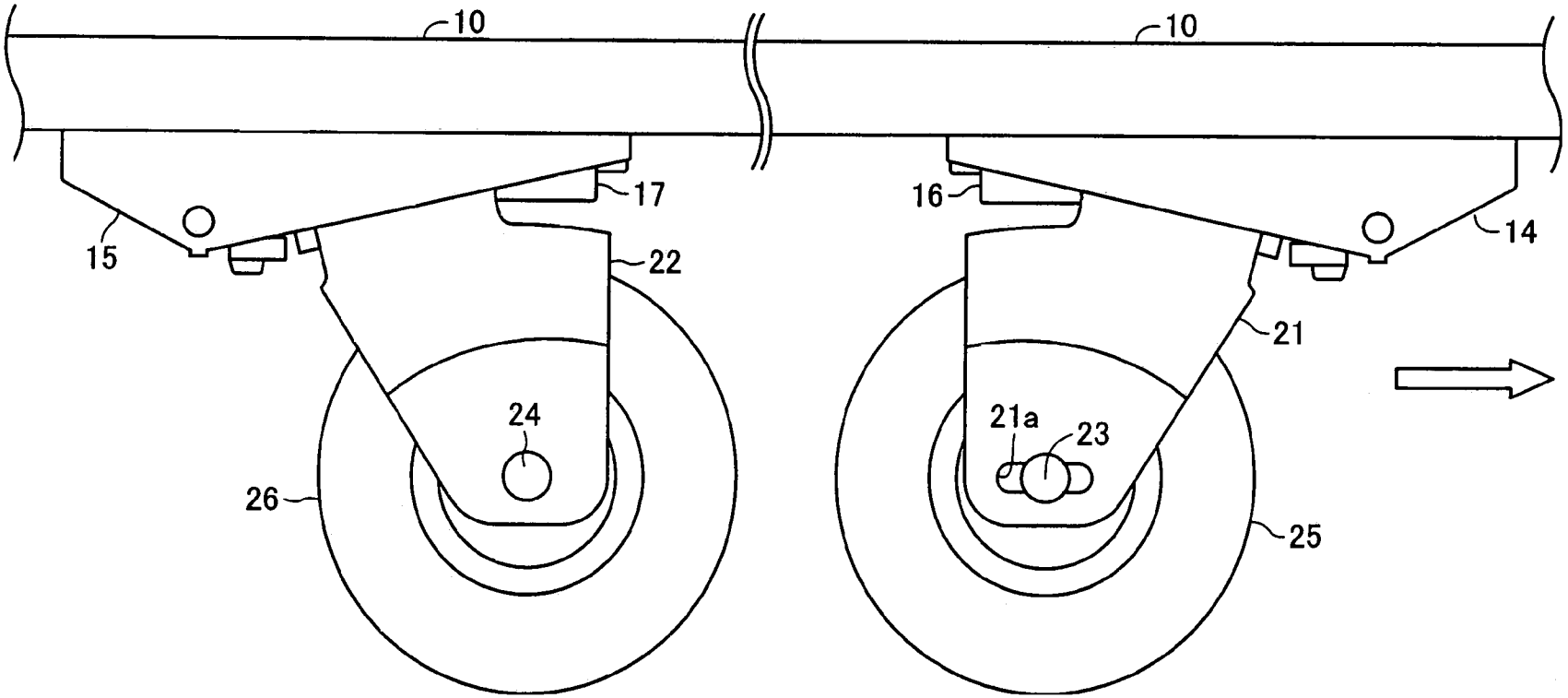
FIG. 2 is a side view showing the front and rear of the skateboard.

Provided on the undersurface of the front and rear of the board 10, respectively, as shown in FIGS. 1 and 2 are arms 21, 22 that are open downward and shaped like a letter U in cross section, with a pair of first frames 14, 15 and a pair of second frames 16, 17 disposed therebetween. The arms 21, 22 rotatably support a front wheel 25 and rear wheel 26, with a pair of fixing screws 23, 24 disposed at the right and left sides. The front wheel 25 and rear wheel 26 have a tire formed of elastically deformable rubber or resin in an approximately cylindrical shape. When viewing the sectional surface including the rotation axis line, the outer surface of the tire has an arc-shape at the right and left edges (see FIG. 5). At the right and left sides of the arm 21 of the front wheel 25 there are formed slits 21*a* respectively extending in the front and rear direction. Due to the slits 21*a*, the position in the front and rear direction where the fixing screw 23 is fixed to the arm 21 is left adjustable, in other words, the position in the front and rear direction where the front wheel 25 is fixed to the arm 21 is left adjustable. The adjustment of fixing position allows a change in distance in the front and rear direction between the rotation axis of the front wheel 25 and the rotation axis of the rear wheel 26, making the cornering ability of the skateboard SB adjustable.

Figure 3:
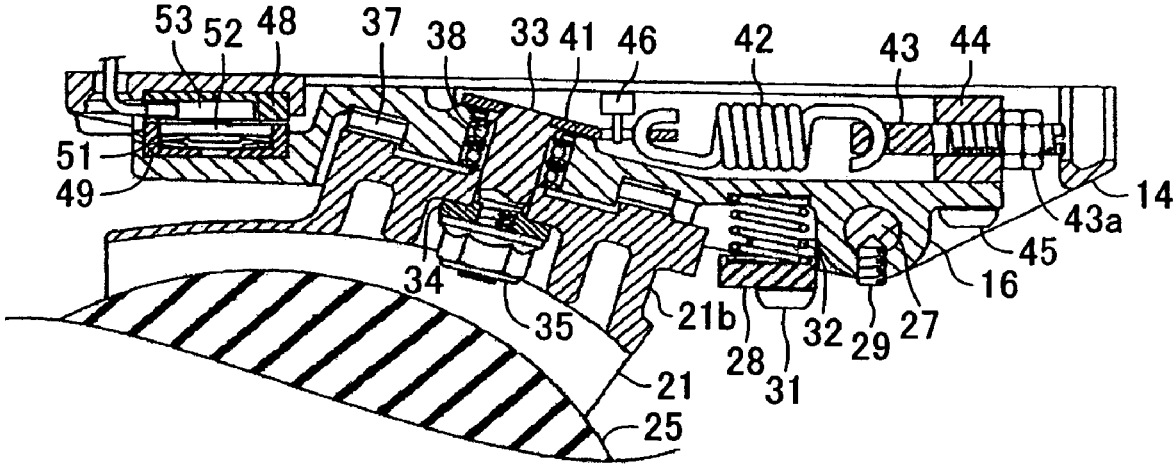
FIG. 3 is a sectional view in which the skateboard is cut along the front and rear direction to show how an arm is fixed to a board.
Figure 4:
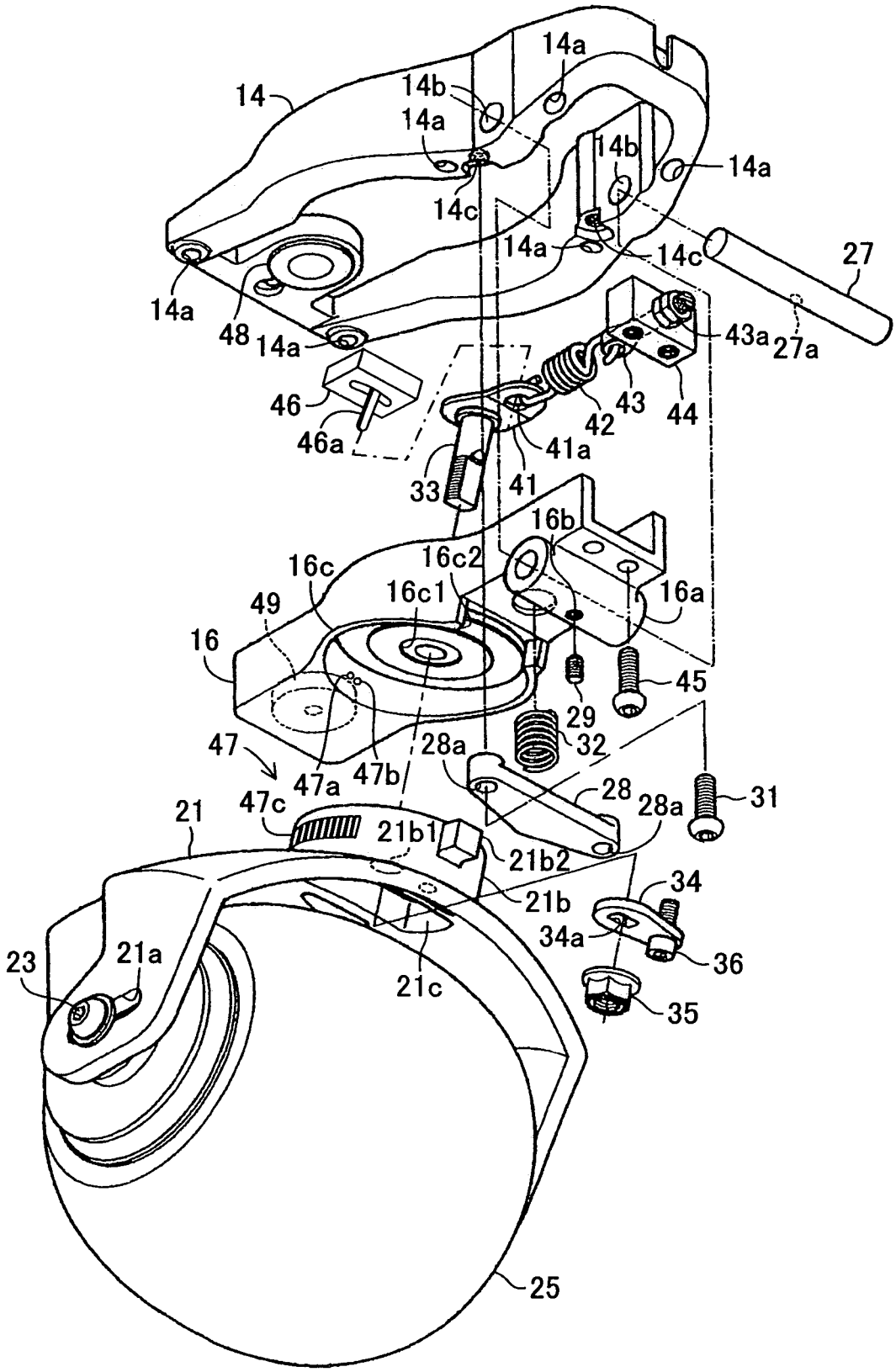
FIG. 4 is an exploded perspective view showing how the arm is fixed to the board.

Next explained will be how the arms 21, 22 of the front wheel 25 and rear wheel 26 are fixed to the board 10. Both the arms 21, 22 are fixed to the board 10 in the same manner except the placement in the front and rear direction, therefore, only how the arm 21 of the front wheel 25 is fixed to the board 10 will be explained in detail. FIG. 3 is a sectional view in which the board 10 is cut along the front and rear direction to show how the arm 21 is fixed to the board 10. FIG. 4 is an exploded perspective view showing how the arm 21 is fixed to the board 10.

The first frame 14 is formed to have a hollow horseshoe shape. At the projection of the first frame 14 there are formed a plurality of (six in the present embodiment) holes 14*a* that are vertically drilled through. The first frame 14 is fixed to the undersurface of the board 10 with a screw which is not shown. At both the right and left sides of the first frame 14 there are also formed a pair of holes 14*b*, 14*b* that are horizontally drilled through. The second frame 16 is shaped like a letter U in cross section and formed to have a long length in the front and rear direction. The second frame 16 is fit in the inner surface of the first frame 14. On the undersurface of the front of the second frame 16 there is integrally formed a sleeve 16*a* that extends in the horizontal direction. In a state where the second frame 16 is fit in the first frame 14, when a columnar connecting shaft 27 is pierced through the holes 14*b*, 14*b* formed on the first frame 14 and the sleeve 16*a*, the second frame 16 is supported by the first frame 14 to be oscillatable about the axis line of the connecting shaft 27. On the underside of the sleeve 16a there is formed an internal thread 16*b* that is drilled through, while on the outersurface of the connecting shaft 27 there is formed a bottomed hollow 27*a*. To prevent the connecting shaft 27 from slipping off, there is provided an external thread 29 that is inserted to the hollow 27*a* through the internal thread 16*b*.

On the underside of the second frame 16 there is provided a long holder 28 that horizontally straddles the second frame 16 so as to be mounted to the first frame 14 with a pair of external threads 31, 31 (only one of them is shown). These external threads 31, 31 pass through a pair of penetrated holes 28*a*, 28*a* from below upward provided at the both edges of the holder 28 to be engaged with a pair of internal threads 14*c*, 14*c* provided on both the right and left sides of the first frame 14. This structure curbs the above-described downward oscillation of the rear of the second frame 16 about the axis line of the connecting shaft 27. Between the upper surface of the holder 28 and the undersurface of the second frame 16 there is provided a compression spring 32 whose axis line direction is vertical. This compression spring 32 reduces impact exerted on the second frame 16 from the front wheel 25.

At the midsection in the front and rear direction of the second frame 16 there is formed a rotation supporting part 16*c* having a columnar concave portion on the undersurface thereof. Housed in the columnar concave portion is a columnar rotating portion 21*b* that is integrally formed at the midsection of the upper surface of the arm 21, the rotating portion 21*b* being rotatable about the axis line. At the midsection of the rotation supporting part 16*c* there is formed a penetrated hole 16*c*1, while at the midsection of the rotating portion 21*b* there is also formed a round penetrated hole 21*b*1. Passed through these penetrated holes 16*c*1, 21*b*1 from above downward is a columnar rotational axis 33. The upper part of the rotational axis 33 that faces the inner surface of the penetrated holes 16*c*1, 21*b*1 is shaped like a column, however, the side surfaces of the lower part of the rotational axis 33 that is positioned below the penetrated hole 21*b*1 are cut off in the axis line direction to form a pair of parallel side surfaces, with an external thread being formed on a pair of remaining arc-shaped side surfaces. Mounted to the lower part of the rotational axis 33 is a plate 34 having a fitting hole 34*a* whose shape agrees with the section of the lower part. The plate 34 is unrotatably fitted into a concave portion 21*c* having a rectangular shape that is formed on the undersurface of the upper wall of the arm 21. By engaging the lower part of the rotational axis 33 with a nut 35 from beneath the plate 34, the rotational axis 33 is integrally rotatably fixed to the arm 21. The plate 34 is fastened to the bottom face of the concave portion 21*c* of the arm 21 with an external thread 36.

Due to the above-described structure, the rotational axis 33 rotates integrally with the arm 21 about its axis line. In order to facilitate the rotation, provided in between the top surface of the rotating portion 21*b* and the undersurface (ceiling) of the rotation supporting part 16*c* of the second frame 16 is a bearing 37, while in between the upper part of the rotational axis 33 and inner surface of the penetrated hole 16*c*1 of the rotation supporting part 16*c* of the second frame 16 there is provided a bearing 38. On the side of the rotating portion 21*b* of the arm 21 there is formed a protrusion 21*b*2, while a notch 16*c*2 having a specified width is formed on part of the side wall of the rotation supporting part 16*c* that houses the rotating portion 21*b*. When the rotation supporting part 16*c* houses the rotating portion 21*b*, the protrusion 21*b*2 protrudes outward from the notch 16*c*2, so that the bumping of the protrusion 21*b*2 against the edges of the side wall of both sides of notch 16*c*2 limits the rotational range of the arm 21.

The upper end of the rotational axis 33 is secured to an end of a connecting plate 41 by welding. The other end of the connecting plate 41 is connected to an end of a connecting rod 43, with a tension spring 42 provided in between. The rod 43 slidably passes through a penetrated hole provided on a fixed member 44, and is movably engaged with the fixed member 44 by the threaded engagement between an internal thread provided on the other end of the connecting rod 43 and a nut 43*a*. The fixed member 44 is fixed to the second frame 16 by a pair of external threads 45, 45 (only one of them is shown) that are inserted from the front edge of the undersurface of the second frame 16. The above-described connecting plate 41, tension spring 42, connecting rod 43 and fixed member 44 are displaceably housed in a concave portion provided at the front of the second frame 16. The tension of the tension spring 42 can be adjusted by adjusting the position of the connecting rod 43 in the axis line direction, so that the rotational characteristics of the rotational axis 33, that is, the steering characteristics of the front wheel 25 can be adjusted.

Into a hole 41*a* of the connecting plate 41 to which an end of the tension spring 42 is fastened there is slidably inserted a movable element 46*a* of a potentiometer that is a component of a steering angle sensor 46. The main body of the steering angle sensor 46 is fixed to the undersurface of the board 10. The movable element 46*a* is rotationally displaced by the rotation of the rotational axis 33 and connecting plate 41, so that the steering angle sensor 46 outputs a voltage signal that corresponds to the rotationally displaced position of the movable element 46*a*. The voltage signal represents a rotational angle of the rotational axis 33, that is, a steering angle θ of the front wheel 25, therefore, hereinafter the voltage signal will be referred to as a steering angle signal. When the front wheel 25 is in a neutral state (that corresponds to a later-described straight-ahead state of the skateboard SB), the steering angle θ indicates "0". In a state where the front wheel 25 is steered to the left (that corresponds to a later-described left cornering state of the skateboard SB), the steering angle θ becomes negative, and the absolute value of the steering angle θ indicates the amount of steering in the left direction. In a state where the front wheel 25 is steered to the right(that corresponds to a later-described right cornering state of the skateboard SB), the steering angle θ becomes positive, and the absolute value of the steering angle θ indicates the amount of steering in the right direction.

Instead of the steering angle sensor 46, a steering angle sensor 47 provided on the second frame 16 and the arm 21 may be used. The steering angle sensor 47 is composed of a light-emitting element 47*a* and a light-receiving element 47*b* that are embedded in the inner surface of the rotation supporting part 16*c* of the second frame 16 to oppose to the outer surface of the rotating portion 21*b* of the arm 21, and a striped reflector 47*c* provided on the outer surface of the rotating portion 21*b*. In the steering angle sensor 47, light emitted by the light-emitting element 47*a* is reflected by the reflector 47*c* and received by the light-receiving element 47*b*. The steering angle sensor 47 is designed such that when the rotating portion 21*b* is rotated, the amount of light received by the light-receiving element 47*b* varies in accordance with the stripe of the reflector 47*c* so as to change a counted value in response to the change in the amount of received light. As a result, the resultant counted value indicates a steering angle θ. In this case, it is necessary to conduct a zero-point correction of the steering angle by clearing the counted value to "zero" in a state where the arm 21 and front wheel 25 are positioned in neutral. Instead of the above-described steering angle sensor which uses light, furthermore, a magnetic steering angle sensor which uses magnetic pulse train may be employed. Such steering angle sensor may be designed such that magnetic pulse train signals are generated by combination of an electromagnetic pick-up and a plurality of magnets opposing to the electromagnetic pick-up. The above-described steering angle sensor may be modified such that the magnetic permeability of the electromagnetic pick-up and the portion opposing to the electromagnetic pick-up varies at specified intervals to generate magnetic pulse train signals.

At the undersurface of the rear part of the first frame 14 there is formed a circular concave portion. Fitted into the concave portion is a bottomed cylindrical holder 48 having an opening in the lower part thereof. On the upper surface of the second frame 16 as well there is formed a circular concave portion that opposes to the holder 48. Into the concave portion there is fitted a bottomed cylindrical holder 49 having an opening in the upper part thereof. Between the holders 48, 49, there are provided a coned disc spring 51, a plate 52 and a load sensor 53 that are placed in this order from the bottom. The coned disc spring 51 alleviates impact propagated from the front wheel 25 through the second frame 16 and first frame 14. The plate 52, which is made of aluminum, is contacted with the load sensor 53. The load sensor 53 senses a load W1 imposed from the board 10 through the first frame 14 to the second frame 16, and outputs a load signal representative of the sensed load W1. Used as the load sensor 53 is a load cell, for example, however, any sensor can be used as far as it is able to sense a load.

Figure 5:
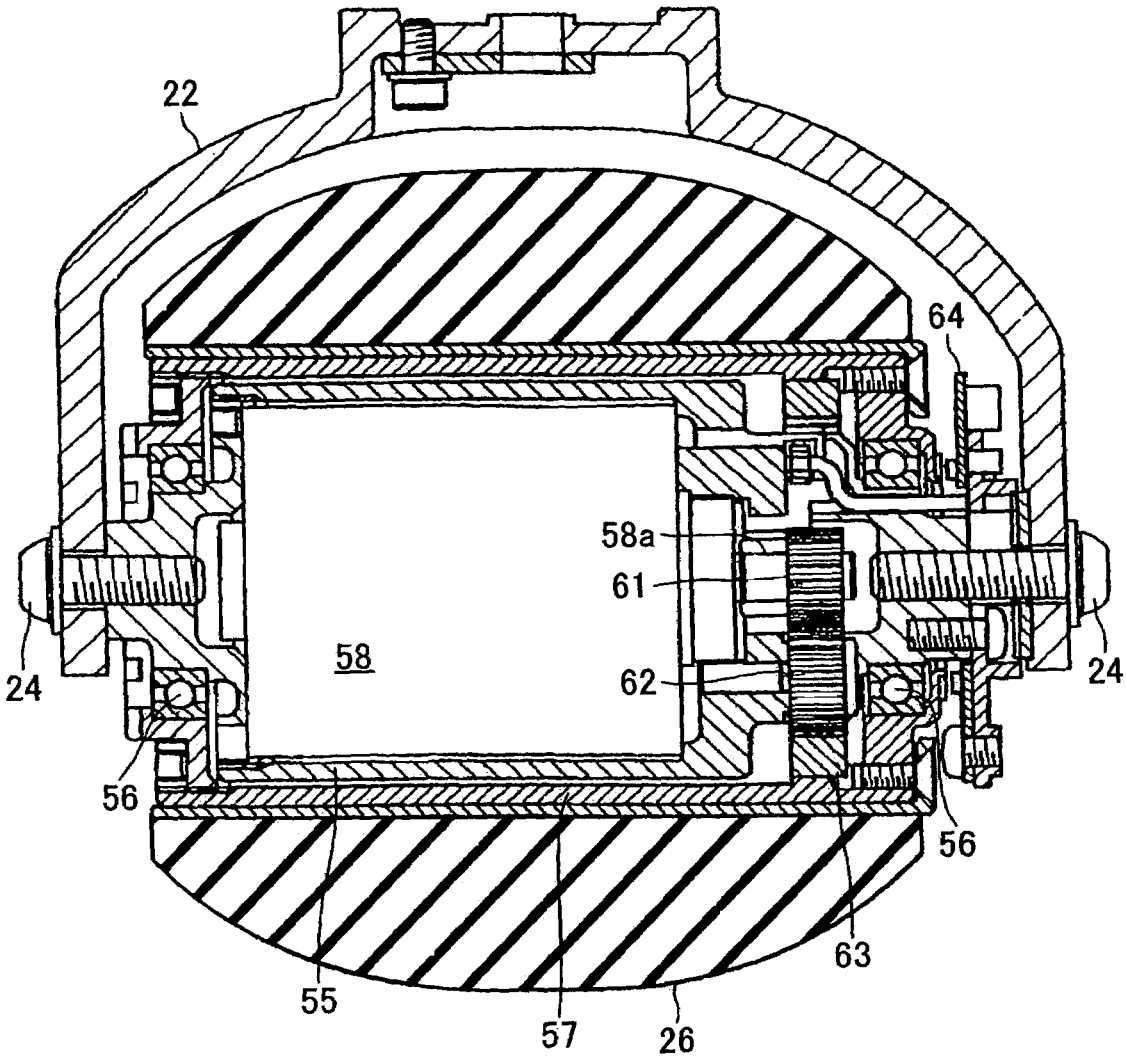
FIG. 5 is a longitudinal sectional view of a rear wheel which is a drive wheel of the skateboard.

Next explained with reference to longitudinal sectional view of FIG. 5 will be a drive mechanism for rotating and driving the rear wheel 26 which is a drive wheel. At the inside of the arm 22 of the rear wheel 26, a fixing sleeve 55 is fixed by the fixing screws 24 and an axis line of the fixing sleeve 55 is in a horizontal direction. On the outer surface of the fixing sleeve 55 a rotational sleeve 57 is rotatably supported through bearings 56, 56. On the outer surface of the rotational sleeve 57 the rear wheel 26 is mounted to rotate integrally with the rotational sleeve 57. The tire of the rear wheel 26 is made of the same material as that of the front wheel 25 to have the same shape as the front wheel 25. In the fixing sleeve 55 a motor 58 is housed. To a rotational axis 58*a* of the motor 58 a drive gear 61 is fixed to integrally rotate. The drive gear 61 is engaged through a mid-gear 62 with an internal gear 63 that is fixed on the inner surface of the rotational sleeve 57 to integrally rotate and used as an output gear. As a result, the rotation of the motor 58 brings the rear wheel 26 to rotate and drive. Also mounted on the arm 22 is a rotational speed sensor 64 which senses the rotation of the rotational sleeve 57 and has an encoder for outputting a rotational speed signal representative of rotational speed V of the rear wheel 26. The rotational speed sensor 64 may be replaced with such rotational speed sensor as picks up the rotation of the gear and outputs a rotational speed signal representative of rotational speed V.

As described above, furthermore, the arm 22 of the rear wheel 26 is mounted to the undersurface of the rear part of the board 10, with the first and second frames 15, 17 interposed therebetween as in the case of the arm 21 of the front wheel 25. Between the first and second frames 15, 17 a load sensor 65 is mounted which is similar to the load sensor 53 of the front wheel 25. The load sensor 65 outputs a load signal representative of a load W2 imposed to the rear part of the board 10. To the rear wheel 26, however, any steering angle sensor such as the steering angle sensor 46 of the front wheel 25 is not mounted.

On the undersurface of the board 10, in addition, a floor sensor 66 and distance sensor 67 are mounted as shown in FIG. 1. The floor sensor 66, which includes a CCD camera, CMOS camera or the like, shoots the surface of a road in order to sense the color, light and shade, etc. of the floor on which the board 10 travels. The floor sensor 66 then outputs a floor signal that contains image data PD of the shot floor. The distance sensor 67, which includes an ultrasonic sensor or the like, senses a distance H from the board 10 to the floor to which the board 10 opposes. The distance sensor 67 then outputs a sensing signal representative of the distance H. For mounting the floor sensor 66 and distance sensor 67, the midsection in the front and rear direction or the front end of the board 10 is suitable. Alternatively, the position on which the floor sensor 66 and the distance sensor 67 are mounted may be left variable.

Figure 6:
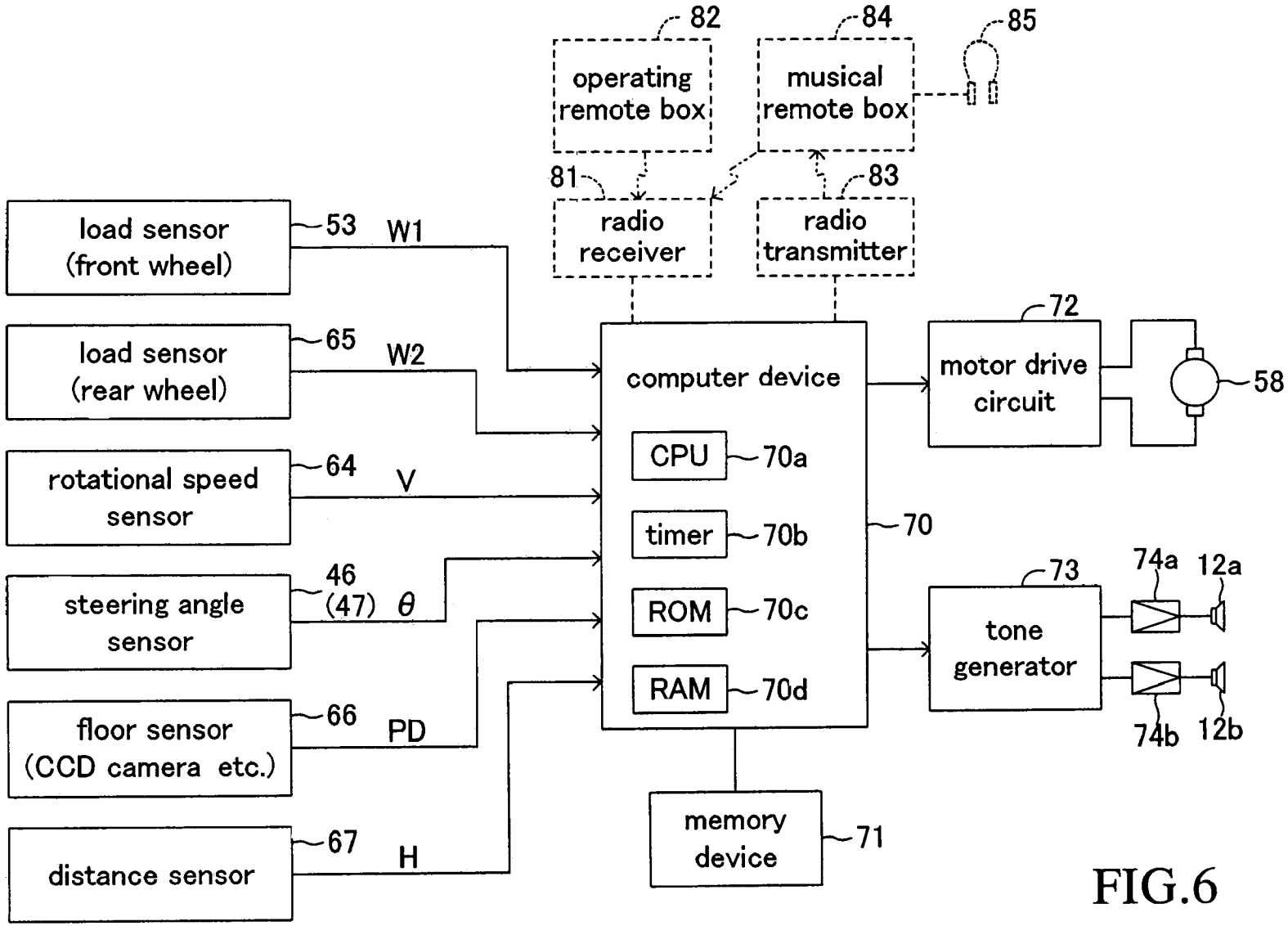
FIG. 6 is a circuit block diagram showing an electrical control device of the skateboard.

Next explained will be an electrical control device contained in the control box 13. As shown in FIG. 6, the electrical control device includes a computer device 70 that is connected with the load sensors 53, 65, the rotational speed sensor 64, the steering angle sensor 46 (or 47), the floor sensor 66 and the distance sensor 67. The computer device 70 is composed of a microcomputer that is equipped with a CPU 70*a*, timer 70*b*, ROM 70*c* and RAM 70*d*. In FIG. 6, a battery for supplying power to the respective electric circuits is not shown. Connected with the computer device 70 are a memory device 71, motor drive circuit 72 and tone generator 73.

The memory device 71 includes a nonvolatile memory such as an EEPROM or flash memory. The memory device 71 stores various programs including a drive control program shown in FIG. 7 and a performance process program shown in FIG. 8 (including a tone generation routine shown in FIG. 9) as well as various data including music data for generating musical tones used in the performance process program. The music data include, as shown in FIG. 10, different sets of automatic performance data, different sets of tone color data, and different sets of effect control data. The sets of automatic performance data are arranged in accordance with the passage of time. Each set of the automatic performance data is composed of a series of performance data necessary for the automatic performance of a musical piece such as tempo data, tone color data, tone volume data, key-on data, key-off data, etc. The automatic performance data may be a series of performance data capable of performing only rhythm performance composed of percussion tones. The automatic performance data may also be a series of performance data capable of performing only melody performance or accompaniment tone performance. Alternatively, the automatic performance data may be a series of performance data including both the rhythm performance and the melody or accompaniment tone performance. The tone color data is the data for specifying a tone color of musical tones to be generated (e.g., tone colors of guitar, bass, cymbal, drum, etc.). The effect control data is the control data for adding various effects to musical tones to be generated such as reverberation effect, amplitude modulation effect, frequency modulation effect, etc.

The motor drive circuit 72 drives and controls the motor 58 under the control of the computer device 70. The tone generator 73 generates musical tone signals and outputs the generated tone signals to speakers 12*a*, 12*b* through amplifiers 74*a*, 74*b* on the basis of instructions given by the computer device 70.

Figure 11:
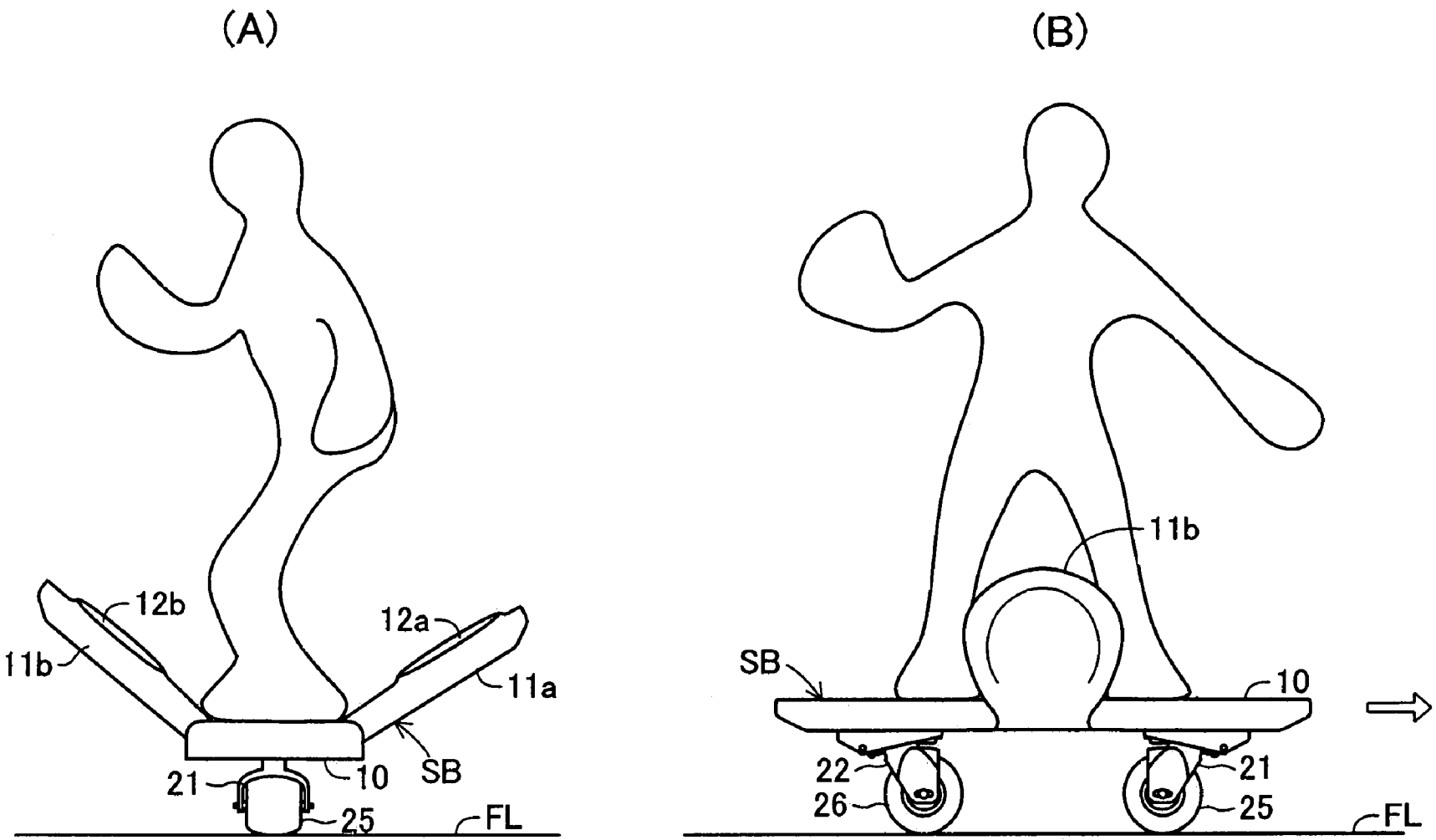

The operation of a first embodiment configured as described above will be explained. After turning on a power switch that is disposed on the control box 13 but is not shown, a player rides on the board 10 as shown in FIG. 11(A), (B). FIG. 11(A) is a schematic sketch in which the player riding the board 10 is viewed from the front, while FIG. 11(B) is a schematic sketch in which the player is viewed from the right. In this state, the player moves his/her body to shift the center of gravity of his/her body from mid-above the board 10 to the front or rear, or the right or left.

Figure 7:
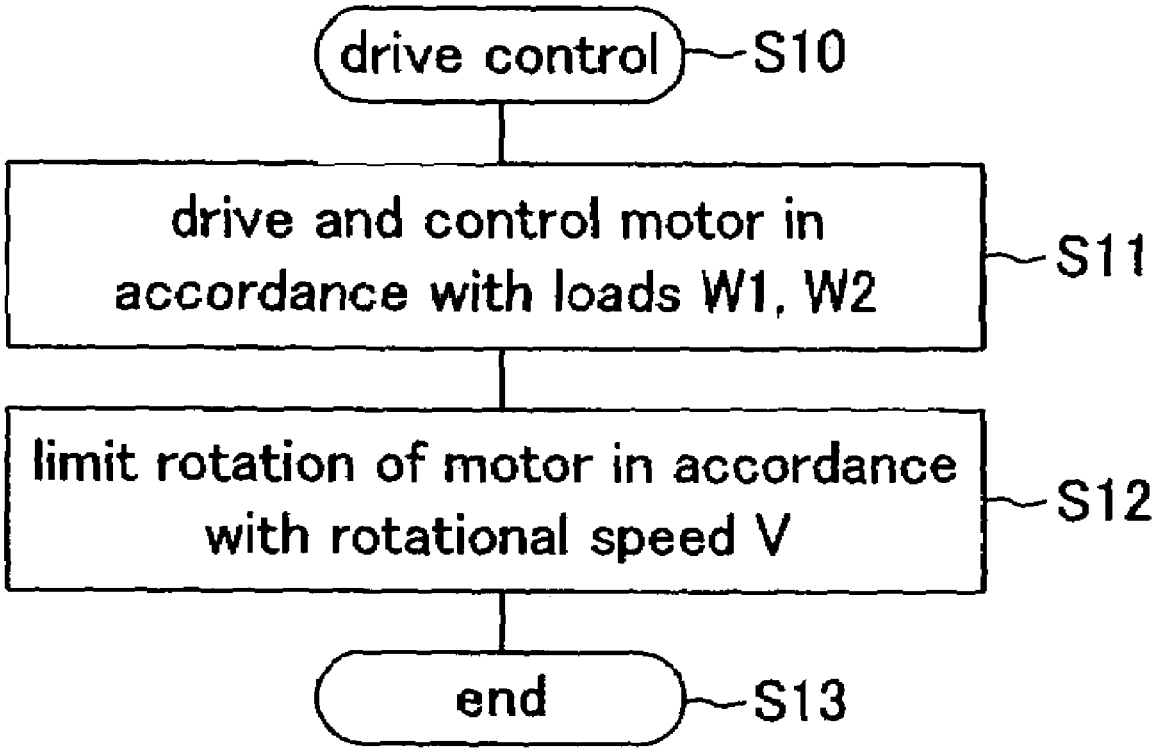
FIG. 7 is a flowchart showing a drive control program executed by a computer device shown in FIG. 6.

At this state, the computer device 70 repeatedly executes the drive control program shown in FIG. 7 at established short periods. The drive control program is started at step S10, and the computer device 70 inputs, at step S11, the loads W1, W2 sensed by the load sensors 53, 65 respectively to drive and control the motor 58 in accordance with the input loads W1, W2. However, since the input loads W1, W2 are not digitized values directly applicable to the computer device 70, an interface circuit provided in the computer device 70 converts the loads W1, W2 into digitized values that are directly applicable to the computer device 70. On the drive control of the motor 58, when the center of gravity of the player's body is placed mid-above the board 10, the loads W1, W2 are equal, so that the computer device 70 controls the motor 58 to stop. When the player shifts the center of gravity of his/her body toward the front from the center of the board 10, the load W1 becomes larger than the load W2, so that the computer device 70 drives the motor 58 forward, resulting in the forward rotation of the rear wheel 26. Since the forward rotation of the rear wheel 26 is designed to bring about the forward movement of the skateboard SB, the skateboard SB moves forward. When the player shifts the center of gravity of his/her body toward the rear from the center of the board 10, on the other hand, the load W2 becomes larger than the load W1, so that the computer device 70 drives the motor 58 backward. Since the backward rotation of the motor 58 brings about the backward rotation of the rear wheel 26, the skateboard SB moves backward.

At the forward movement and backward movement of the skateboard SB, furthermore, supplied to the motor 58 is a driving current of an amount that increases with the increase in the absolute value of the difference between the loads W1, W2. Therefore, the more forward the player shifts the center of gravity of his/her body, the more rapid acceleration the skateboard SB gains to move forward. The more backward the player shifts the center of gravity of his/her body, the more rapid acceleration the skateboard SB gains to move backward. As explained above, by shifting the center of gravity of the body forward or backward, the player can move the skateboard SB forward or backward at a desired speed or stop the skateboard SB.

After step S11, at step S12 the computer device 70 inputs a rotational speed V sensed by the rotational speed sensor 64, and limits the rotation of the motor 58 when the rotational speed V is larger than a predetermined value. The limited rotation of the motor 58 keeps the forward speed and backward speed of the skateboard SB within a predetermined speed to secure the player's safety. After step S12, the drive control program is terminated at step S13.

Figure 12:
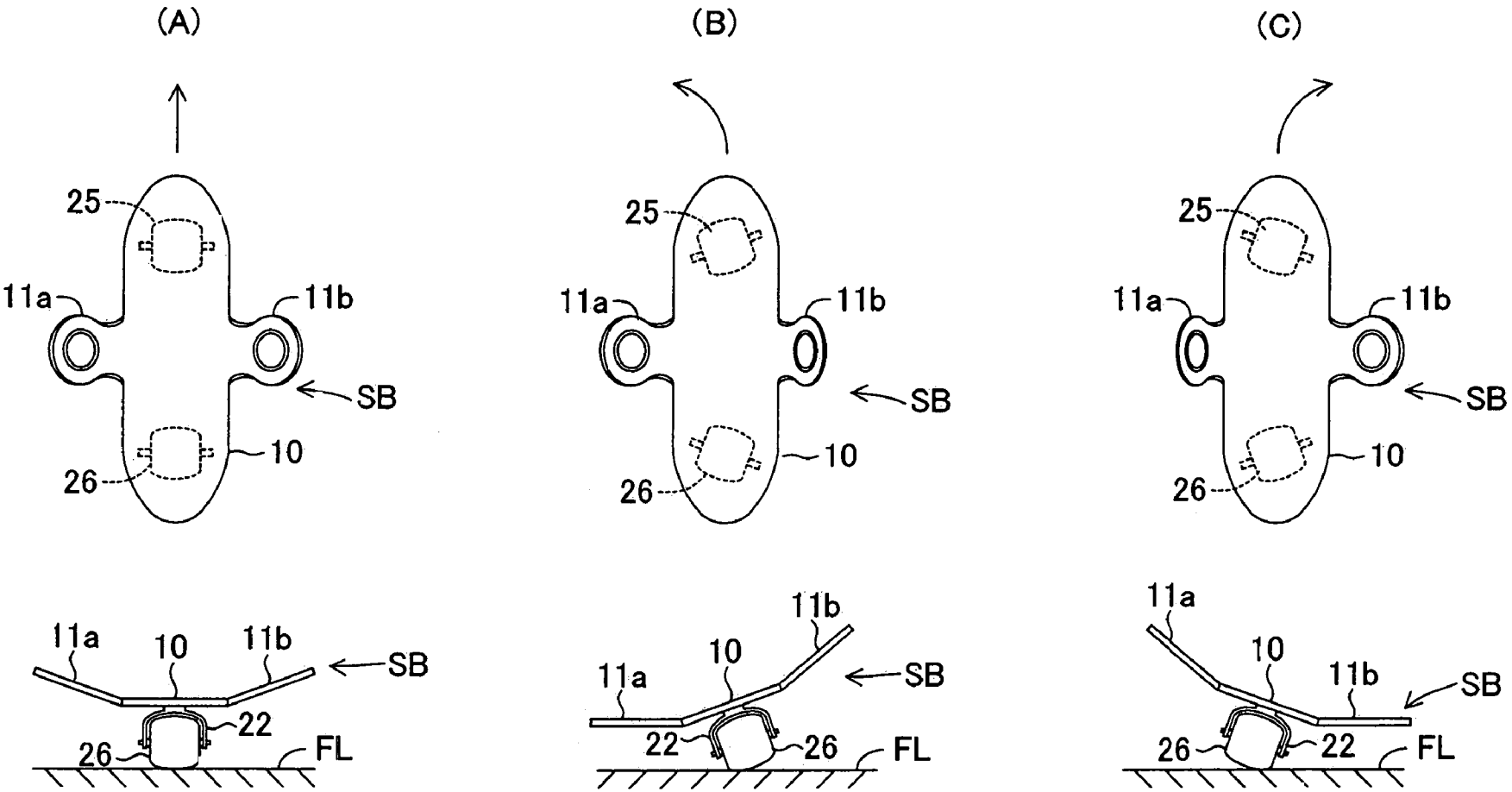
FIG. 12(A) is a diagrammatic sketch of the skateboard viewed from above and rear when moving straight ahead.
FIG. 12(B) is a diagrammatic sketch of the skateboard viewed from above and rear when turning to the left.
FIG. 12(C) is a diagrammatic sketch of the skateboard viewed from above and rear when turning to the right.

Next explained will be cornering of the running skateboard SB. To turn the skateboard SB, the player shifts his/her weight horizontally with respect to the board 10 by twisting his/her body or the like to tilt the board 10 to the right or left. FIGS. 12(A) to (C) are diagrammatic sketches in which the board 10, front wheel 25 and rear wheel 26 are viewed from above and the rear when the skateboard SB moves straight ahead, turns to the left, and turns to the right, respectively. When the player places the center of gravity of his/her body horizontally at the center of the board 10, the rotational axis 33 is positioned in neutral, so that the central part of the front wheel 25 and rear wheel 26 contacts a floor FL (see FIG. 12(A)). In this case, the skateboard SB moves straight ahead.

When the player shifts the center of gravity of his/her body to the left of the board 10, on the other hand, the left part of the front wheel 25 and rear wheel 26 contacts the floor FL (see FIG. 12(B)). In this case, the rotational axis of the front wheel 25 rotates to the left with respect to the first and second frames 14, 16 when viewed from above, so that the front wheel 25 is steered to the left, whereas the rear wheel 26 is steered in the direction opposite to the front wheel 25. As a result, the skateboard SB is turned to the left, with the left side of the board 10 positioned as the center of rotation. When the player shifts the center of gravity of his/her body to the right of the board 10, the right part of the front wheel 25 and rear wheel 26 contacts the floor FL (see FIG. 12(C)). In this case, the rotational axis of the front wheel 25 rotates to the right with respect to the first and second frames 14, 16 when viewed from above, so that the front wheel 25 is steered to the right, whereas the rear wheel 26 is steered in the direction opposite to the front wheel 25 in this case as well. As a result, the skateboard SB is turned to the right, with the right side of the board 10 positioned as the center of rotation.

As described above, the skateboard SB is turned to the right or left by the horizontal shift of the player's weight. The larger the amount of the horizontal shift of the player's weight becomes, the further outward the part of the front wheel 25 and rear wheel 26 that contacts the floor FL shifts to produce a larger rotation with respect to the reference position of the rotational axis 33 of the front wheel 25 and rear wheel 26. Therefore, the rotational radius of the turning skateboard SB is determined on the basis of the amount of the player's horizontal shift of his/her weight.

Figure 13:
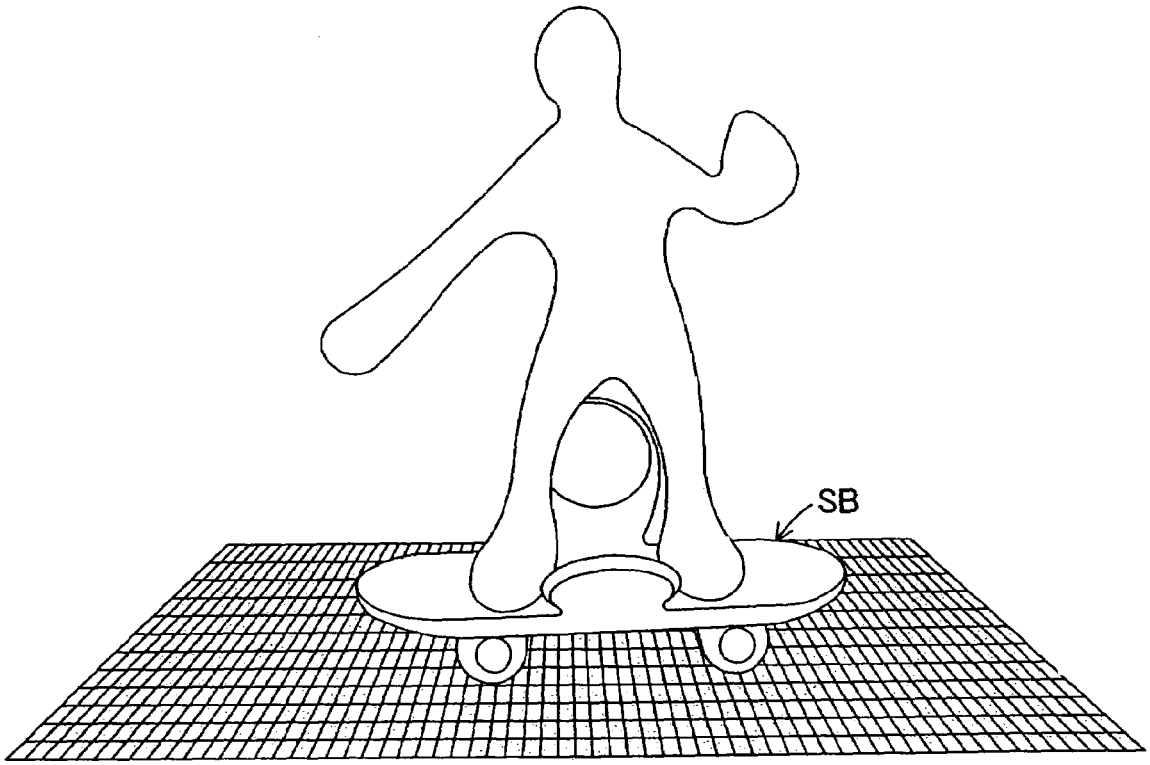
FIG. 13 is a schematic sketch showing a state in which the skateboard moves on an uneven tiled floor.
Figure 14:
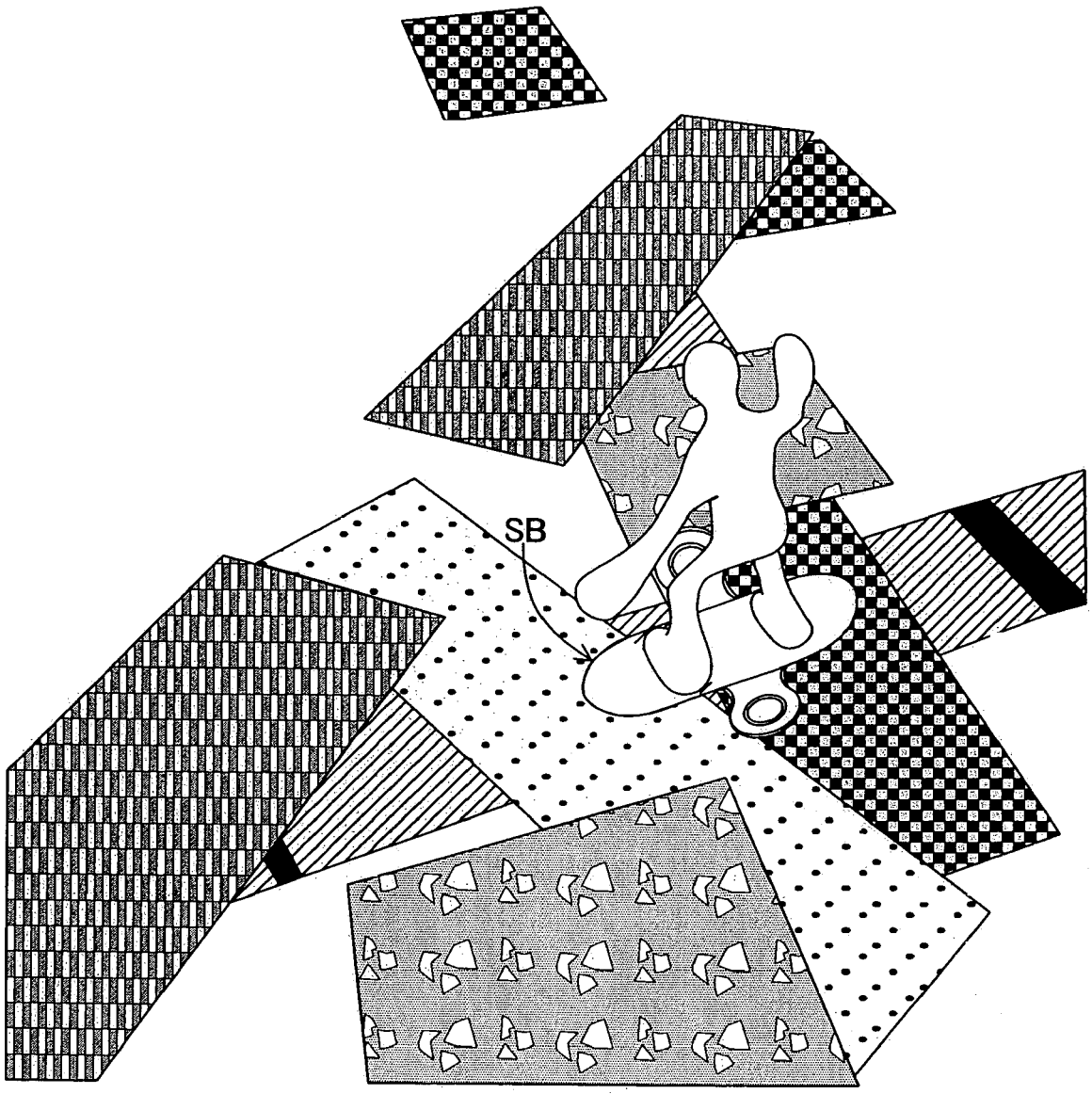
FIG. 14 is a schematic sketch showing a state in which the skateboard moves on a stage, floor or the like to which colors are applied and whose lightness is varied.

Next explained will be generation of musical tones by the skateboard SB. The skateboard SB is characterized in that modes of generating musical tones are varied when the skateboard SB travels on an uneven floor or a floor having varied colors and/or light and shade. Therefore, the skateboard SB delivers its characteristics when the skateboard SB travels on an uneven tiled floor as shown in FIG. 13 or on a stage or floor having various colors and/or light and shade as shown in FIG. 14. In addition, before riding on the skateboard SB, the player operates operators provided in the control box 13 to select a desired set of automatic performance data from among sets of automatic performance data.

Figure 8:
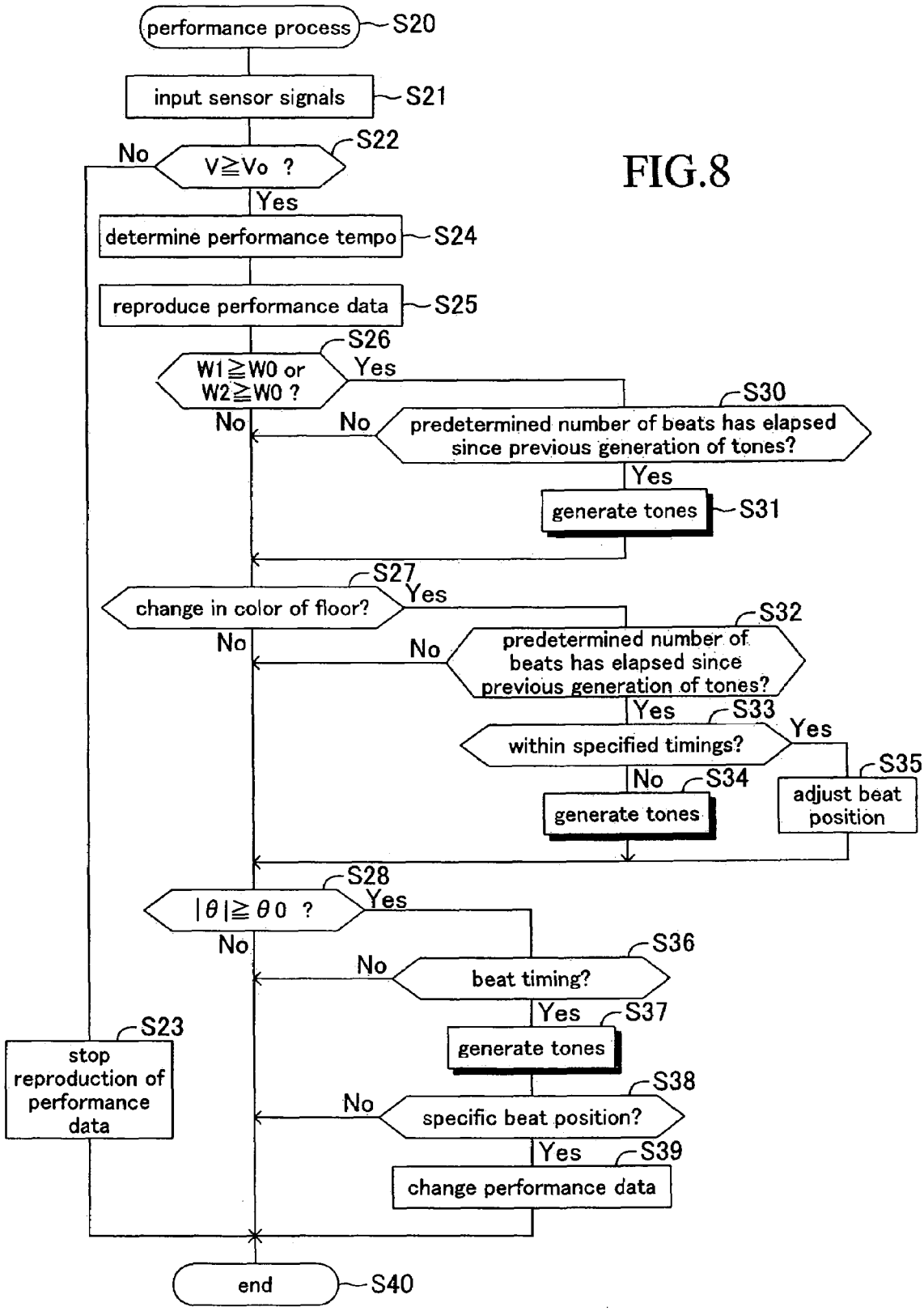
FIG. 8 is a flowchart showing a performance process program executed by the computer device shown in FIG. 6.

The computer device 70 repeatedly executes the performance process program shown in FIG. 8 at established short periods in parallel with the execution of the above-described drive control program shown in FIG. 7. The performance process program is started at step S20, and at step S21 there are inputted loads W1, W2 from the load sensors 53, 65, a rotational speed V from the rotational speed sensor 64, a steering angle θ from the steering angle sensor 46, image data PD from the floor sensor 66, and a distance H from the distance sensor 67. Since the rotational speed V, steering angle θ, image data PD and distance H to be inputted are not digitized values directly applicable to the computer device 70, the computer device 70 converts these values into directly applicable digitized values through the interface circuit provided in the computer device 70 by execution of a program that is not shown.

At step S22 it is determined whether the inputted rotational speed value V is a predetermined small value Vo or more in order to determine whether the skateboard SB is in motion or stopped. If the skateboard SB is stopped in a state where automatic performance data is being reproduced, the reproduction of the automatic performance data is stopped at step S23. If the skateboard SB is stopped in a state where any automatic performance data is not being reproduced, the state is kept at step S23. Then, at step S40, the performance process program is temporarily terminated. If the skateboard SB is started moving, on the other hand, processes for generating musical tones are conducted at step S24 and later. At step S24, the performance tempo of the automatic performance is determined in accordance with the rotational speed V. On this determination, the performance tempo indicated by tempo data contained in the automatic performance data that has been selected initially by the player is regarded as the reference tempo. As the rotational speed V becomes faster than a predetermined reference speed, the performance tempo also becomes faster than the reference tempo. As the rotational speed V becomes slower than the predetermined reference speed, on the other hand, the performance tempo also becomes slower than the reference tempo.

Next, the automatic performance data that has been selected by the player is reproduced at step S25. On the reproduction of the automatic performance data, if the skateboard SB has been in a halt state at the previous execution of the performance process program, the performance data is read out from the top. Alternatively, this may be modified such that when the skateboard SB is stopped, a position at which the performance data has been already read out is stored, so that the reading of the performance data is resumed from the position when the skateboard SB is started moving again. If the skateboard SB has been moving at the previous execution, the performance data is continuously read out in sequence in accordance with the passage of time. The speed to read out the performance data in accordance with the passage of time corresponds with the above-determined performance tempo. If end data has been read out at the previous execution, the same performance data as the previous execution is read out from the top. This may be modified such that when end data is read out at the previous execution, a different set of automatic performance data (e.g., in a case where automatic performance data 1 has been read out at the previous process, automatic performance data 2) is read out from the top.

The performance data, that is, key-on data, key-off data, tone color data, tone volume data, etc. that has been read out in accordance with the passage of time as described above is then supplied to the tone generator 73. The tone generator 73 generates musical tone signals in sequence on the basis of thus-supplied key-on data, key-off data, tone color data and tone volume data, and supplies the generated musical tone signals to the speakers 12*a*, 12*b* through the amplifiers 74*a*, 74*b*. Then, the speakers 12*a*, 12*b* emit automatically performed music (melody, accompaniment, and rhythm), so that the player can enjoy the skateboard SB while listening to the music.

After step S25, determination processes of steps S26, S27 and S28 are conducted to control the modes for generating musical tones. At step S26 it is determined whether either the load W1 or W2 is equal to or more than a predetermined value Wo, in other words, whether the player has drastically shifted his/her weight frontward or rearward to drastically accelerate or decelerate the skateboard SB. At step S27 it is determined on the basis of the above-inputted image data PD whether the color of the floor on which the skateboard SB is driving has been changed. At step S28 it is determined whether the absolute value |θ| of the steering angle θ is equal to or more than a predetermined value θo, in other words, whether the player is drastically turning the skateboard SB. When none of these determination conditions is applicable, "No" is given to steps S26, S27, S28 to temporarily terminate the performance process program at step S40. In this state, the above-described automatic performance of the musical piece is continued as long as the skateboard SB is moving. On the automatic performance in this state, the performance tempo of the automatic performance is changed by the process of step S24 in accordance with the speed at which the skateboard SB is moving.

When the player drastically shifts his/her weight frontward or rearward to drastically accelerate or decelerate the skateboard SB, "Yes" is given to step S26 to determine at step S30 whether the predetermined number of beats or bars (e.g., one or more bars) or more have elapsed since the previous generation of musical tones. This determination is done in order to avoid frequent occurrence of later-described generation of musical tones. Therefore, only when the predetermined number of beats or bars or more have elapsed since the previous generation of musical tones, a routine of step S31 for generating musical tones is conducted.

Figure 9:
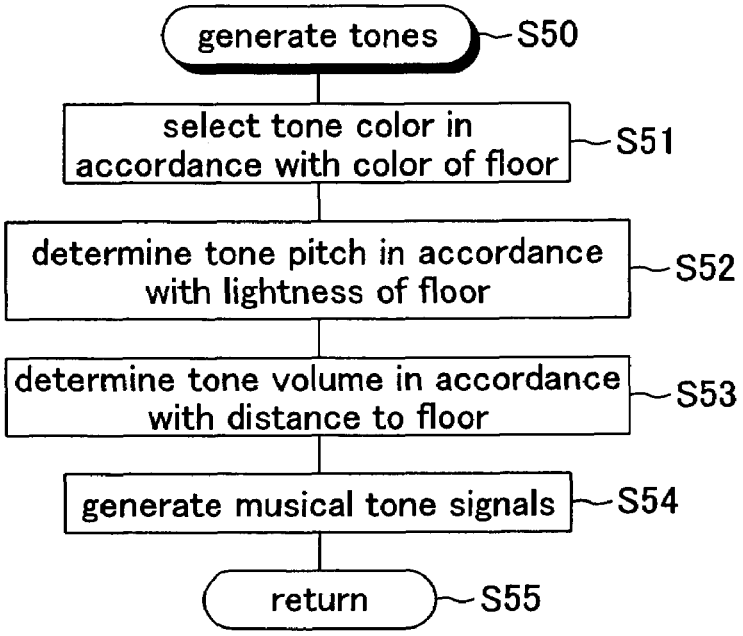
FIG. 9 is a flowchart showing the detail of a routine for generating musical tones contained in the performance process program shown in FIG. 8.
Figure 10:
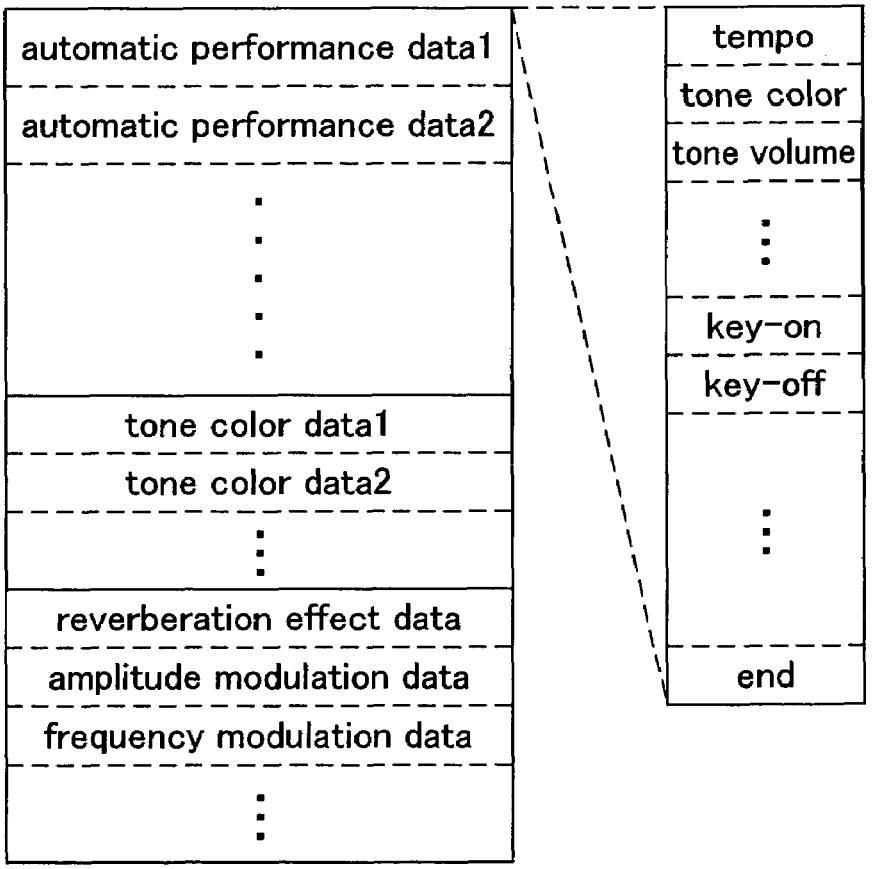
FIG. 10 is a format of data stored in a memory device shown in FIG. 6.

The routine for generating musical tones is started at step S50 of FIG. 9. Then, at step S51 the color of the floor is identified on the basis of the above-inputted image data PD (floor signal) to select a tone color of the musical tones to be generated in accordance with the identified color. On this selection, on the basis of a predetermined selection rule, a set of tone color data is selected from among sets of tone color data (see FIG. 10) stored in the memory device 71 in accordance with the identified color. Then, at step S52 the lightness (light and shade) of the floor is identified on the basis of the inputted image data PD to determine, on the basis of the identified lightness, the pitch of musical tones to be generated. The relationship between lightness and pitch is previously defined so that the tone pitch is determined on the basis of the previously defined relationship. Examples of the previously defined relationship may include the amount of pitch that becomes higher as the lightness becomes higher. In a case where a tone color of a percussion instrument such as a drum and cymbal which does not have pitch has been selected at step S51, however, the lightness may define the frequency characteristic to be added to musical tones to be generated. Then, at step S53 the tone volume of musical tones to be generated is determined in accordance with the inputted distance H to the floor. On this determination of the tone volume as well, the relationship between tone volume and distance H is previously defined so that the tone volume is determined on the basis of the previously defined relationship. Examples of the previously defined relationship include the amount of tone volume that increases as the distance H becomes larger. The distance H could vary with projections and depressions of the floor. In addition, the distance H also changes when the skateboard SB is turned, although the distance H depends on the position where the distance sensor 67 is mounted. In addition to the control of tone volume level, the control of tone volume also includes the control of amplitude envelope.

Then, at step S54 tone generation control data for generating tone signals having the selected tone color with the above-determined pitch and tone volume is supplied to the tone generator 73, and at step S55 the routine for generating musical tones is terminated. The tone generator 73 generates tone signals on the basis of the supplied tone generation control data, and outputs the generated tone signals to the speakers 12*a*, 12*b* through the amplifiers 74*a*, 74*b*. Consequently, in accordance with the acceleration or deceleration of the skateboard SB brought about by the player, the skateboard SB emits musical tones that correspond to the conditions of the floor FL.

When the color of the floor on which the skateboard SB is driving has been changed, "Yes" is given to step S27 to determine at step S32 as in the case of step S30 whether the predetermined number of beats or bars (e.g., one or more bars) or more have elapsed since the previous generation of musical tones. When the determination is positive, it is determined at step S33 whether the timing at which the color of the floor has been changed falls within specified timings of the currently reproduced automatic performance. For instance, it is determined whether the timing at which the color of the floor has been changed falls within specified timings that precede a bar position. If the change of the color has not occurred within the specified timings, "No" is given to step S33 to conduct the routine for generating musical tones at step S34 to generate musical tones corresponding to the floor conditions. If the change of the color has occurred within the specified timings, on the other hand, "Yes" is given to step S33 to adjust beat positions of automatic performance at step S35. For example, the progression of the automatic performance is modified such that the timing of the color change agrees with the bar timing of the automatic performance.

Figure 15:
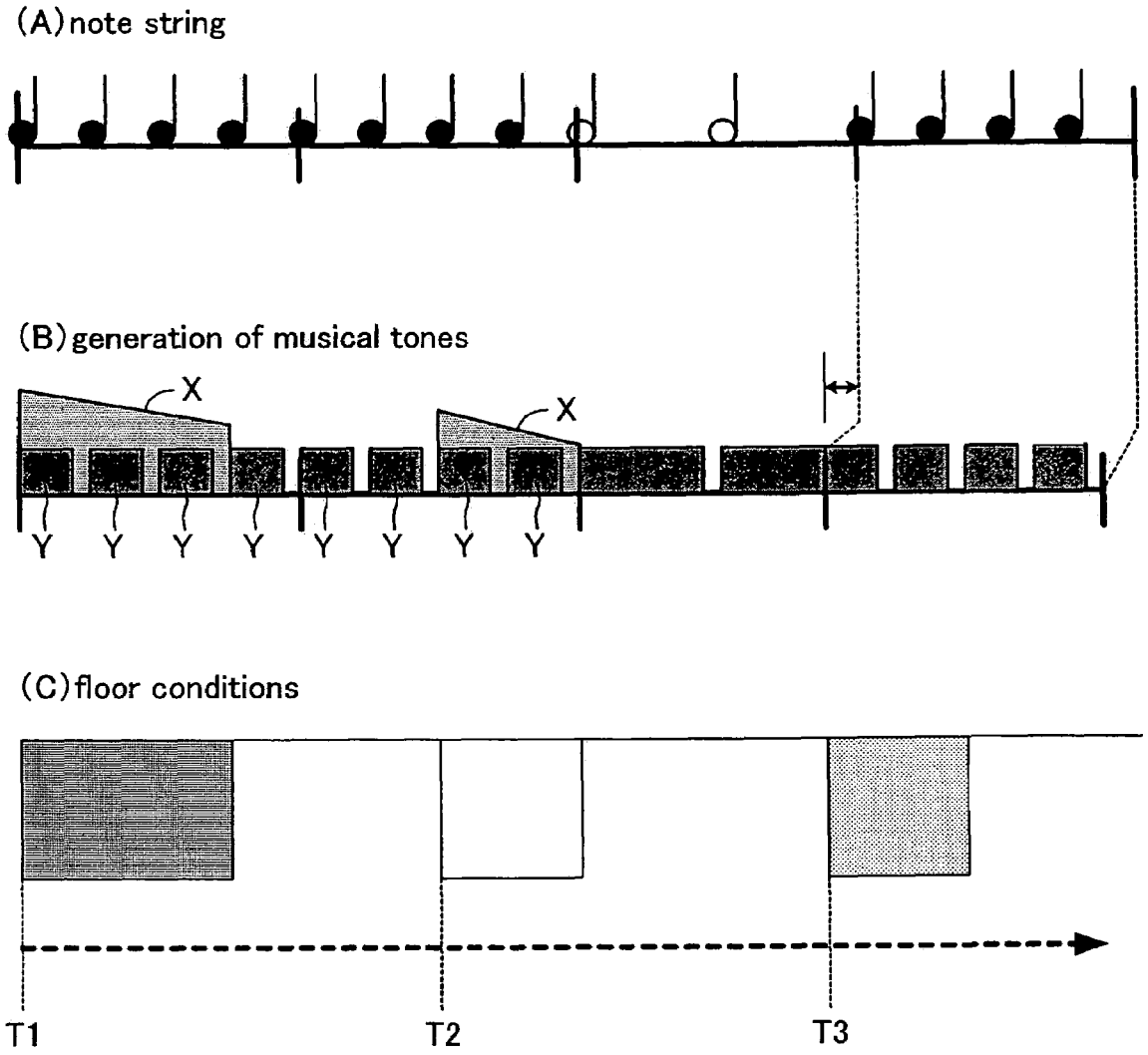
FIG. 15 is an explanatory drawing which explains that musical tones to be generated are controlled in accordance with the conditions of the floor on which the skateboard moves.

Now, the control in steps S33 to S35 will be described in detail. FIG. 15 illustrates the control in steps S33 to S35. FIG. 15(A) shows a string of notes played by the automatic performance, while FIG. 15(C) illustrates the floor conditions on which the skateboard SB drives. If the color of the floor changes at timings T1, T2, musical tones X that are accompanied by the change in color of the floor and brought at step S34 are generated in addition to the note string of automatic performance tones Y as shown in (B). At timing T3 indicative of the change in color of the floor which falls within the specified timings, the progression of the automatic performance is modified to have timings for generating musical tones as shown in (B).

As a result, when the player rides on the skateboard SB on the floor FL (e.g., on a stage) having different colors as shown in FIG. 14, the skateboard SB generates musical tones that correspond to the conditions of the floor FL in accordance with the changes in color of the floor FL. Furthermore, timings at which automatic performance tones are generated agree with the changes in color of the floor FL.

If the player suddenly turns the skateboard SB, "Yes" is given to step S28 to determine at step S36 whether the timing of the hard cornering agrees with a beat timing. More specifically, a specified small margin of time is provided before and after a beat timing of automatic performance, and it is determined whether the timing of the hard cornering falls within the margin of time. If the timing of the hard cornering agrees with a beat timing, "Yes" is given to step S36 to conduct the routine for generating musical tones at step S37 and generate musical tones that correspond to the floor conditions. As a result, the player is able to generate musical tones that correspond to the conditions of the floor FL by suddenly turning the skateboard SB.

After step S37, it is determined at step S38 whether the timing of the hard cornering agrees with a specific beat timing. More specifically, the specific beat timing indicates a break point such as the first bar, second bar or fourth bar. In this case as well, a specified small margin of time is provided before and after a specific beat position of automatic performance, so that it is determined whether the timing of the hard cornering falls within the margin of time. Then, if the timing of the hard cornering agrees with a specific beat position, the automatic performance data is changed to a different set of automatic performance data at step S39. Then, the performance process program is temporarily terminated at step S40. The different set of automatic performance data may be selected from among sets of automatic performance data in the order that has been defined by the player using operators which are provided in the control box 13 but are not shown. Alternatively, the automatic performance data to be replaced may be selected in predetermined order (e.g., in the order of sets of automatic performance data stored in the memory device 71). Consequently, the player is able to switch automatic performance data one after the other by suddenly turning the skateboard SB to switch automatically performed musical piece or automatically performed pattern such as melody, accompaniment and rhythm.

As obvious from the above explanation, the first embodiment can bring about changes corresponding to the player's operation on the skateboard SB and the floor conditions in automatically performed music, while allowing the player to ride the skateboard SB. In addition to the automatically performed musical tones, the first embodiment also enables the skateboard SB to generate additional musical tones in accordance with the player's operation on the skateboard SB and the floor conditions, allowing the player to enjoy music that is rich in variation during the ride. Furthermore, the first embodiment even makes the player feel as if the player is playing a musical instrument because the player can control the skateboard SB to generate musical tones corresponding to the changes in driving conditions. Particularly, when the player rides the skateboard SB on a systematically uneven tiled floor as shown in FIG. 13, a floor having various patterns and colors as shown in FIG. 14, or a floor having a barcode, the skateboard SB can provide the player with variety of performances. In such situation, riding the skateboard SB can be an entertainment show.

Furthermore, the first embodiment may be variously modified as follows. In the first embodiment, for example, when the skateboard SB is drastically accelerated or decelerated, steps S30, S31 are conducted. When the color of the floor on which the skateboard SB is driving has been changed, steps S32 to S35 are conducted. When the skateboard SB is suddenly turned, steps S36 to S39 are conducted. However, the first embodiment may be modified such that steps S32 to S35, or steps S36 to S39 are conducted at the time of hard acceleration or deceleration, steps S30, S31, or steps S36 to S39 are conducted at the time of the change in the color of the floor on which the skateboard SB is driving, and steps S30, 31, or steps S32 to S35 are conducted at the time of hard cornering of the skateboard SB.

In the first embodiment, moreover, the tone color, pitch and volume (amplitude envelope) of musical tones to be generated are determined by the routine for generating musical tones shown in FIG. 9. However, the first embodiment may be modified such that the tone pitch or volume of musical tones to be generated is determined on the basis of the color of the floor, or the tone color or volume of musical tones to be generated is determined on the basis of the lightness of the floor, or the tone color of tone pitch of musical tones to be generated is determined on the basis of the distance from the board to the floor.

In the first embodiment, in addition, the modes for generating musical tone signals are controlled in accordance with the steering angle θ, rotational speed V (indicative of forward and backward speed) and loads W1, W2 (indicative of forward and backward acceleration) each representative of the amount of the movement of the skateboard SB. However, the first embodiment may be modified such that the modes for generating musical tone signals are controlled in accordance with the lateral acceleration, lateral speed, traveling direction, angle speed and the like of the skateboard SB in addition to, or in replacement for the above-described amount of the movement. In this case, the skateboard SB may be equipped with sensors that sense the lateral acceleration, lateral speed, traveling direction, angle speed and the like so that the output of the sensors are supplied to the computer device 70 in order to allow the computer device 70 to control the modes for generating musical tones in accordance with the lateral acceleration, lateral speed, traveling direction, angle speed and the like.

In the first embodiment and its variations, furthermore, the amount of the movement of the skateboard SB and the conditions of the floor control the reproduction tempo of automatic performance data, the type of automatic performance data (that is, switching between performance patterns), and the tone pitch, tone color and volume (amplitude envelope) of musical tones to be generated. In addition to, or in replacement for the above, however, the amount of the movement of the skateboard SB and the conditions of the floor may also change or control effects to be added to musical tones to be generated including automatically performed tones. In this case, effect control data stored in the memory device 71 may be selected on the basis of the movement of the skateboard SB and the change in the conditions of the floor, so that the selected effect control data is supplied to the tone generator 73 in order to switch the effect to be added to musical tone signals.

In the first embodiment as shown by broken lines in FIG. 6, furthermore, the computer device 70 is connected with a radio receiver 81 to provide the player with an operating remote box 82. The operating remote box 82 is equipped with a radio transmitter and operators on its operating panel for instructing the travel of the skateboard SB. In this case, in addition to, or in replacement for the operation by the load sensors 53, 65, the player on the skateboard SB operates the operators to instruct the forward and backward acceleration of the skateboard SB. The instruction is transmitted by radio from the operating remote box 82 and received by the radio receiver 81. The radio receiver 81 then transmits the instruction of forward and backward acceleration to the computer device 70. The computer device 70 then conducts a process similar to step S11 shown in FIG. 7 to control the rotation of the motor 58 on the basis of the instruction. On this scheme, the forward and backward acceleration of the skateboard SB is controlled by the operating remote box 82.

In the first embodiment, moreover, the steering of the skateboard SB is controlled by the lateral shifting of the player's weight. In replacement for this scheme, however, a motor-driven steering device in which at least one of the front wheel 25 and the rear wheel 26 is steered may be adopted. In this case, since the skateboard SB is steered laterally, independent of the shifting of the player's weight, it is preferable to compose at least one of the front wheel 25 and the rear wheel 26 out of a pair of side-to-side wheels in order to ensure stable driving of the skateboard SB. On this scheme, the lateral steering of the skateboard SB is also controlled by the operating remote box 82.

In the first embodiment, furthermore, the skateboard SB is driven by the motor 58 that is used as driving source. In replacement for the motor 58, however, the skateboard SB may also be adapted to be driven by human power without using the motor 58. In this case, the player may place one of his/her feet on the board 10 and kick the floor with the other foot to impart rotational force to the front wheel 25 and rear wheel 26, so that the skateboard SB can travel forward and backward.

Furthermore, the computer device 70 may be connected to a radio transmitter 83 in order to transmit musical tone signals by radio from the radio transmitter 83. In this case, the player carries a musical remote box 84 equipped with a radio receiver for receiving musical tone signals transmitted by radio. The player carrying the musical remote box 84 is able to listen to the musical tone signals received by the radio receiver with headphones 85. In addition, the first embodiment may be adapted such that operational signals of operators provided on the musical remote box 84 are transmitted by radio by an integrated radio transmitter to the computer device 70 through the radio receiver 81 in order to transmit various instructions such as selected automatic performance data to the computer device 70.

Furthermore, the first embodiment may also be adapted such that the musical remote box 84 is equipped with a computer device, memory device and tone generator for generating musical tone signals that are similar to the computer device 70, memory device 71 and tone generator 73 of the first embodiment so that musical tone signals can be generated in the musical remote box 84 in order to allow the player to listen to the generated musical tone signals with the headphones 85. In this case, the computer device 70 transmits signals indicative of sensed values W1, W2, V, θ, PD, and H sensed by the sensors 53, 65, 64, 46, 66, and 67 through the radio transmitter 83. The computer device disposed in the musical remote box 84 then executes the performance process program shown in FIG. 8 that is similar to the first embodiment to reproduce music.

Figure 16:
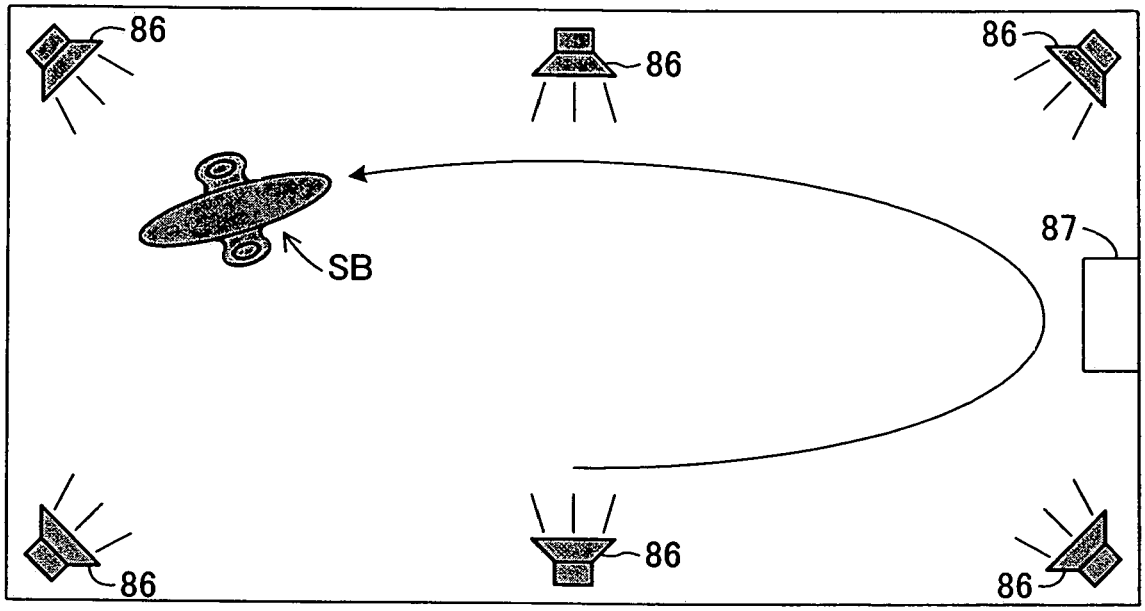
FIG. 16 is an explanatory drawing which explains a state in which the skateboard moves in a space where a plurality of speakers are disposed.

As shown in FIG. 16, furthermore, the first embodiment may also be adapted such that musical tone signals are emitted from a plurality of speakers 86 scattered in a specified space. In this case, in the space there is disposed a controller 87 that is connected to the speakers 86 and equipped with a radio receiver. As is the case with the musical remote box 84, musical tone signals received by the radio receiver are then emitted from the speakers 86. In this case as well as the case of the musical remote box 84, the controller 87 may be equipped with a radio receiver, a computer device, memory device and tone generator to allow-the radio receiver to receive signals indicative of sensed values W1, W2, V, θ, PD, and H sensed by the sensors 53, 65, 64, 46, 66, and 67 and allow the tone generator to generate musical tone signals to supply the generated musical tone signals to the speakers 86.

In this case, furthermore, the controller 87 may also have a position sensor that senses the position of the skateboard SB and the player, so that the tone volume of musical signals (musical tone signals) emitted from the speakers 86 is controlled in accordance with the sensed position in order to move the emitted music through the space in accordance with the move of the player. In this case, for example, the speakers 86 can be adapted such that the speaker 86 closest to the player emits musical signals (musical tone signals) at a high-volume level so that the sound image travels with the position of the player.

b. Second Embodiment

Figure 17:
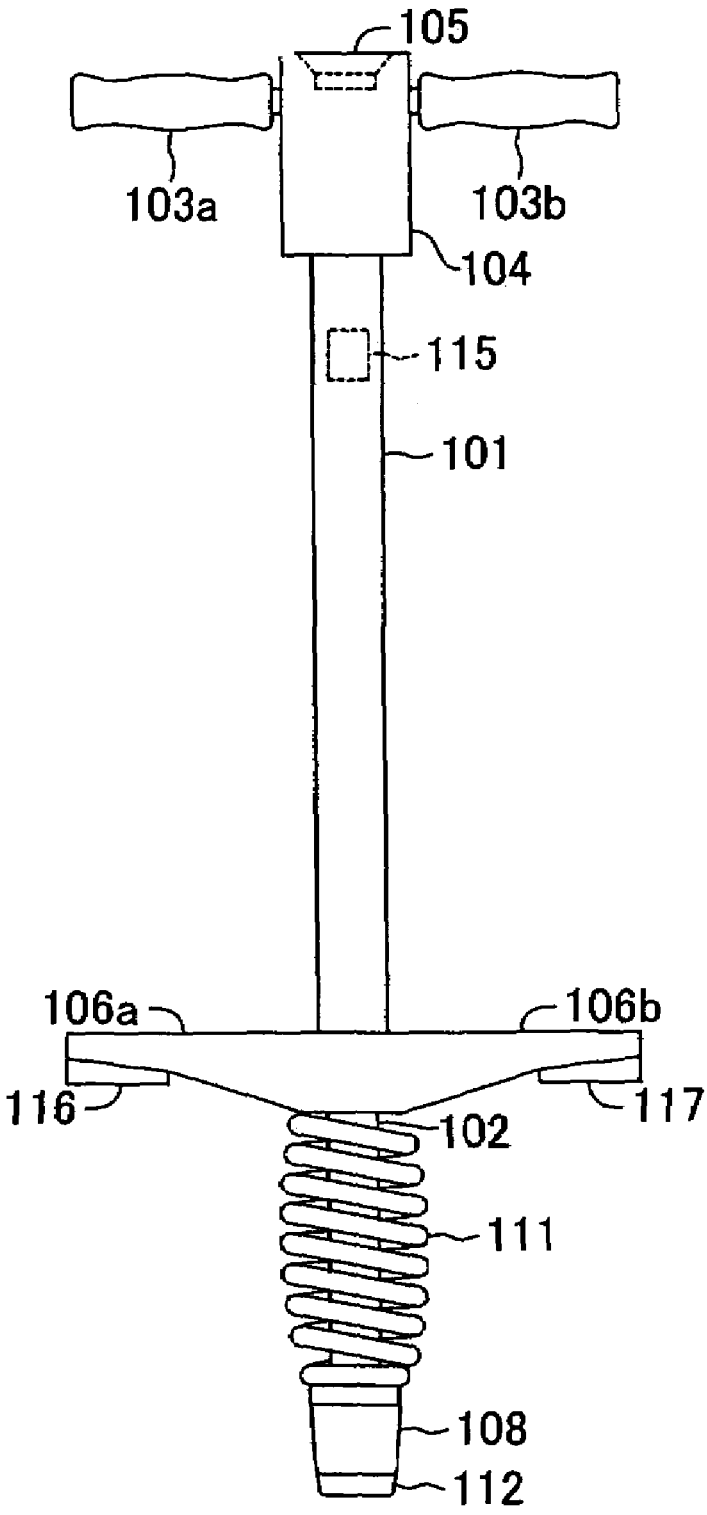
FIG. 17 is a front view of a hopper according to a second embodiment of the present invention.

Next explained will be a second embodiment of the present invention. In the second embodiment, a hopper HP is adopted as a moving apparatus of the present invention. The hopper HP has an upper pipe 101 and a lower rod 102 as shown in FIG. 17.

Figure 18:
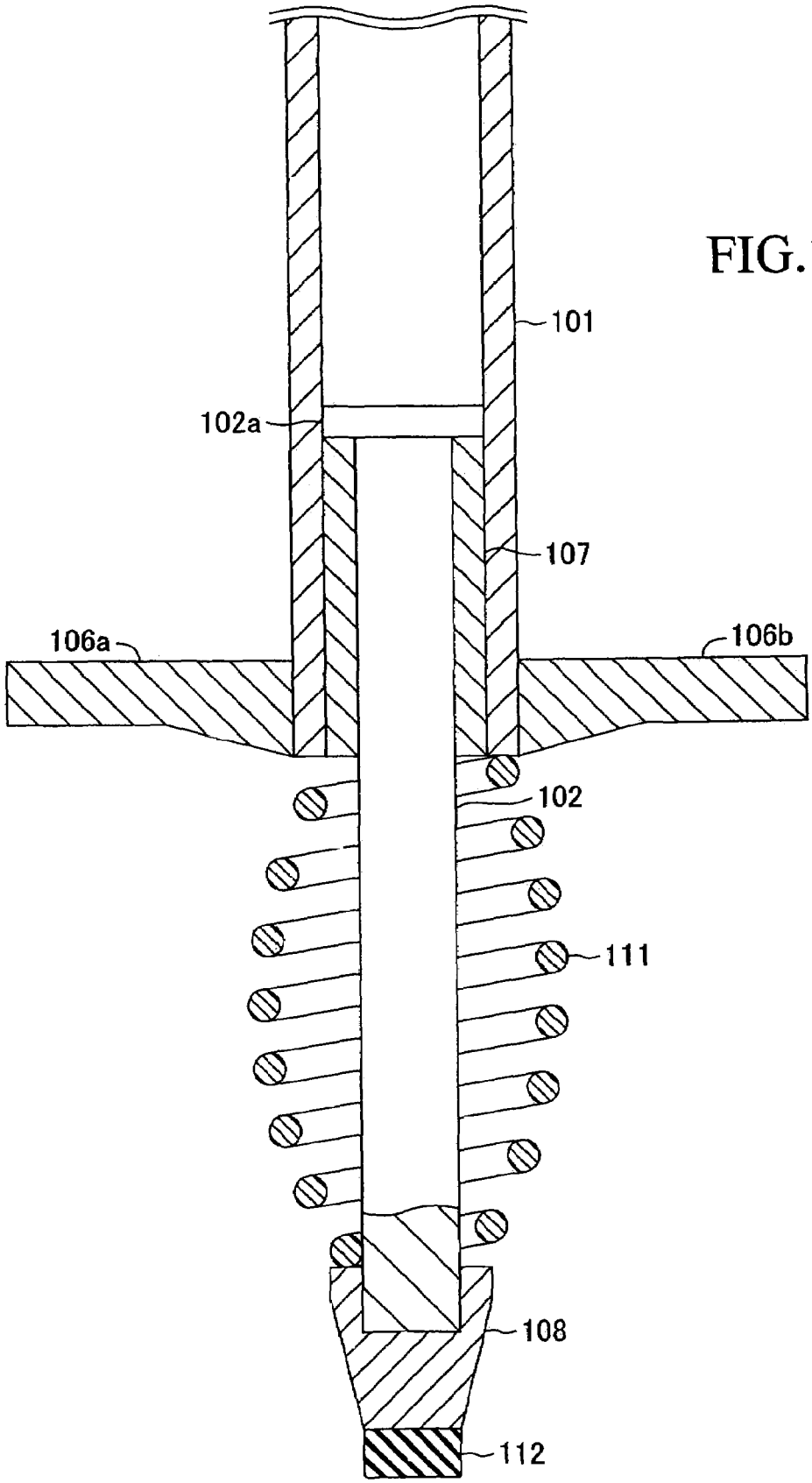
FIG. 18 is a longitudinal sectional view of the lower part of the hopper.

The upper pipe 101 is formed to have a long cylindrical shape. At the top end of the upper pipe 101, grips 103*a*, 103*b* extend in the horizontal direction, with their inner edges being fixed to the upper pipe 101. Disposed between the grips 103*a*, 103*b* is a control box 104 having a speaker 105 that faces upward. At the lower end of the upper pipe 101, foot plates 106*a*, 106*b* extend in the horizontal direction in parallel with the grips 103*a*, 103*b*, with their inner edges being fixed to the upper pipe 101. On the inner surface of the lower end of the upper pipe 101 there is fixed a guide sleeve 107 as shown in FIG. 18.

The lower rod 102 is inserted from the lower part of the upper pipe 101, being slidable on the inner surface of the guide sleeve 107. The lower rod 102 is prevented from slipping off by a flange 102*a* that is provided on the top end of the lower rod 102. Due to the presence of the flange 102*a*, however, the lower rod 102 is inserted from the top end of the upper pipe 101 at the assembly of the second embodiment. On the lower end of the lower rod 102 there is fixed a stopper 108 having a truncated cone shape. On the outer surface of the lower rod 102 there are provided coil springs 111 in between the lower end of the upper pipe 101 and the stopper 108. On the under surface of the stopper 108 there is fixed a cushioning member 112 that is formed of elastic rubber, resin or the like.

In the upper pipe 101 there is provided an acceleration sensor 115. The acceleration sensor 115 senses a vertical acceleration G and outputs an acceleration signal indicative of the acceleration G. On the under surface of the foot plates 106*a*, 106*b* there are provided a floor sensor 116 and a distance sensor 117. The floor sensor 116 and distance sensor 117, which are formed in a manner similar to the floor sensor 66 and distance sensor 67 of the first embodiment, output signals indicative of image data PD and distance H, respectively. The control box 104 is equipped with the computer device 70, memory device 71, tone generator 73 and amplifiers 74*a*, 74*b* that are similar to those employed in the first embodiment.

The player gripping the grips 103*a*, 103*b* with his/her hands and placing his/her feet on the foot plates 106*a*, 106*b* makes jumps, so that the lower rod 102 slides inside the guide sleeve 107 in synchronization with the expansion and contraction of the coil springs 111, allowing the hopper HP to jump on a road or floor to move. At the jumps, the acceleration sensor 115, floor sensor 116, and distance sensor 117 input the acceleration G, image data PD and distance H to the computer device 70 of the control box 104. The acceleration G is a signal indicative of an acceleration (shock) that becomes large in synchronization with the timing at which the player makes a jump. The image data PD and distance H vary with the conditions of a floor on which the hopper HP moves and the vertical position of the hopper HP. In this case as well as the case of the first embodiment, when the hopper HP travels on a tiled floor as shown in FIG. 13 or on a stage or floor having various colors and/or light and shade as shown in FIG. 14, obtained are the image data PD and the distance H that vary with the travel of the hopper HP.

The computer device 70 executes the performance process program shown in FIG. 8 to generate musical signals in accordance with the travel of the hopper HP. In this case, at the determination process of step S22 in FIG. 8, it is determined whether the acceleration G is equal to or more than a specified acceleration Go. At step S24, furthermore, a tempo is determined in accordance with the intervals between which the acceleration G that is equal to or more than the specified acceleration Go is generated. At the determination processes of steps S26, S28, it is determined whether the acceleration G is equal to or more than a specified acceleration G1, or whether the distance H is equal to or less than a specified distance H1. Through these processes, variations are added to the music to be generated in accordance with the jumping force of the hopper HP, the road surface, the floor surface, and the like, enriching the perception of the player. In addition, the player can even feel as if he/she is playing a musical instrument by changing the way he/she operates the hopper HP to generate musical tones corresponding to the change in the movement of the hopper HP.

In the second embodiment as well, the above-described control of the acceleration G, image data PD and distance H, and the modes in which musical tones are generated only shows an example, and as is the case with the first embodiment, various modifications are available.

Figure 19:
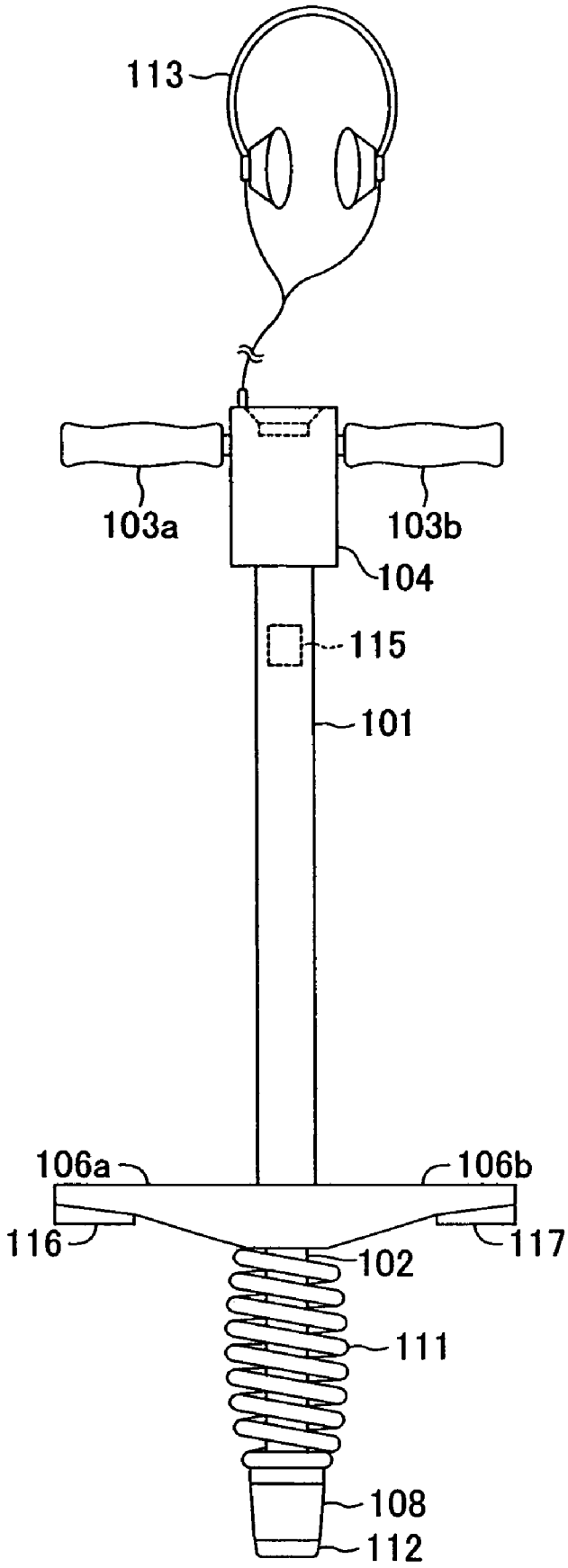
FIG. 19 is a front view showing a modified example of the hopper.

As shown in FIG. 19, the second embodiment can be also modified such that the player listens to the music with headphones 113 instead of the speaker 105. In this case, since the control box 104 is positioned near the player's head, voice signals may be supplied from the control box 104 to the headphones 113 over the wires. Alternatively, the voice signals may also be supplied to the headphones 113 by radio. In this case as well, as shown in the modification of FIG. 16 of the first embodiment, musical signals may be emitted from the speakers 86 scattered in a specified space. In this case as well, the position of the player is sensed so that the sound image of musical tones to be generated travels within the space in accordance with the travel of the player.

In carrying out the present invention, furthermore, it will be understood that the present invention is not limited to the above-described first and second embodiments and their variations, but various modifications may be made without departing from the spirit and scope of the invention.

In the first and second embodiments and their variations, for instance, the road surface and floor surface on which the skateboard SB and hopper HP travel are mentioned as the external conditions. However, the mode for generating musical tones may be changed or controlled in accordance with external conditions other than the above or in accordance with changes in external conditions. The external conditions other than the above include surrounding temperature, surrounding humidity, surrounding brightness, wind velocity, and so on. Furthermore, the present invention is applicable to any moving apparatus other than the skateboard SB and hopper HP as long as the apparatus can travel on a floor in various modes by the player's operations or by the shift of the player's weight.

What is claimed is:

1. A moving apparatus which a human can ride to move, the moving apparatus comprising:

a musical tone signal generating portion for generating a musical tone signal;

an external condition sensing portion for sensing external conditions in which the moving apparatus is placed and which vary with the travel of the moving apparatus, wherein the external condition sensing portion generates a signal including image data representative of the external conditions; and a generation mode controlling portion for controlling a mode in which the musical tone signal is generated by the musical tone signal generating portion in accordance with the sensed external conditions.

2. A moving apparatus according to claim 1, wherein the moving apparatus moves by motor-power or human-power.

3. A moving apparatus according to claim 1, wherein the moving apparatus travels on a floor, and the external conditions indicate a state of the floor on which the moving apparatus travels.

4. A moving apparatus which a human can ride to move, the moving apparatus comprising:

a musical tone signal generating portion for generating a musical tone signal;

an external condition sensing portion for sensing external conditions in which the moving apparatus is placed and which vary with the travel of the moving apparatus; and a generation mode controlling portion for controlling a mode in which the musical tone signal is generated by the musical tone signal generating portion in accordance with the sensed external conditions;

wherein the moving apparatus travels on a floor and the external conditions indicate a state of the floor on which the moving apparatus travels; and wherein the state of the floor includes at least one of lightness of the floor, a color of the floor, a pattern of the floor, and a projection and a depression of the floor.

5. A moving apparatus according to claim 1, wherein the musical tone signal generating portion automatically generates a series of musical tone signals on the basis of a series of performance data, and the generation mode controlling portion changes a mode in which the series of musical tone signals are generated in accordance with the sensed external conditions.

6. A moving apparatus which a human can ride to move, the moving apparatus comprising:

a musical tone signal generating portion for generating a musical tone signal;

an external condition sensing portion for sensing external conditions in which the moving apparatus is placed and which vary with the travel of the moving apparatus; and a generation mode controlling portion for controlling a mode in which the musical tone signal is generated by the musical tone signal generating portion in accordance with the sensed external conditions;

wherein the musical tone signal generating portion automatically generates a series of musical tone signals on the basis of a series of performance data;

wherein the generation mode controlling portion changes a mode in which the series of musical tone signals are generated in accordance with the sensed external conditions; and wherein the mode to be changed includes at least one of a tempo of automatic performance, a timing at which a musical tone signal is generated, and switching of the series of performance data.

7. A moving apparatus which a human can ride to move, the moving apparatus comprising:

a musical tone signal generating portion for generating a musical tone signal;

an external condition sensing portion for sensing external conditions in which the moving apparatus is placed and which vary with the travel of the moving apparatus; and a generation mode controlling portion for controlling a mode in which the musical tone signal is generated by the musical tone signal generating portion in accordance with the sensed external conditions;

wherein the generation mode controlling portion controls, on the basis of the sensed external conditions, a timing at which the musical tone signal generating portion generates the musical tone signal or a musical tone element of the musical tone signal generated by the musical tone signal generating portion.

8. A moving apparatus according to claim 7, wherein the musical tone element includes at least one of a tone pitch of the musical tone signal, a tone color of the musical tone signal, loudness of the musical tone signal and an effect to be added to the musical tone signal.

9. A moving apparatus according to claim 1, wherein the moving apparatus further includes a movement amount sensing portion for sensing the amount of movement indicative of the movement of the moving apparatus, and the generation mode controlling portion controls the mode in which the musical tone signal is generated by the musical tone signal generating portion in accordance with the sensed amount of the movement in addition to the sensed external conditions.

10. A moving apparatus according to claim 9, wherein the amount of movement of the moving apparatus includes at least one of a steering angle, forward and backward acceleration, lateral acceleration, forward and backward speed, lateral speed, traveling direction, and angle speed of the moving apparatus.

11. A moving apparatus system having a moving apparatus which a human can ride to move and an electronic musical apparatus which is disposed apart from the moving apparatus and includes a musical tone signal generating portion for generating a musical tone signal, wherein:

the moving apparatus is provided with an external condition sensing portion for sensing external conditions in which the moving apparatus is placed and which vary with the travel of the moving apparatus, wherein the external condition sensing portion generates a signal containing image data that is indicative of the sensed external conditions, and a transmitting portion for transmitting the signal indicative of the sensed external conditions; and the electronic musical apparatus is provided with a generation mode controlling portion for receiving the signal transmitted from the transmitting portion and controlling, on the basis of the received signal, a mode in which the musical tone signal is generated by the musical tone signal generating portion in accordance with the sensed external conditions.

12. A moving apparatus system according to claim 11, wherein the moving apparatus moves by motor-power or human-power.

13. A moving apparatus system according to claim 11, wherein the moving apparatus travels an a floor, and the external conditions indicate a state of the floor on which the moving apparatus travels.

14. A moving apparatus system having a moving apparatus which a human can ride to move and an electronic musical apparatus which is disposed apart from the moving apparatus and includes a musical tone signal generating portion for generating a musical tone signal, wherein:

the moving apparatus is provided with an external condition sensing portion for sensing external conditions in which the moving apparatus is placed and which vary with the travel of the moving apparatus and a transmitting portion for transmitting a signal indicative of the sensed external conditions; and the electronic musical apparatus is provided with a generation mode controlling portion for receiving the signal transmitted from the transmitting portion and controlling, on the basis of the received signal, a mode in which the musical tone signal is generated by the musical tone signal generating portion in accordance with the sensed external conditions;

wherein the moving apparatus travels on a floor and he external conditions indicate a state of the floor on which the moving apparatus travels; and wherein the state of the floor includes at least one of lightness of the floor, a color of the floor, a pattern of the floor, and a projection and a depression of the floor.

15. A moving apparatus system according to claim 11, wherein the musical tone signal generating portion automatically generates a series of musical tone signals on the basis of a series of performance data, and the generation mode controlling portion changes a mode in which the series of musical tone signals are generated in accordance with the sensed external conditions.

16. A moving apparatus system having a moving apparatus which a human can ride to move and an electronic musical apparatus which is disposed apart from the moving apparatus and includes a musical tone signal generating portion for generating a musical tone signal, wherein:

the moving apparatus is provided with an external condition sensing portion for sensing external conditions in which the moving apparatus is placed and which vary with the travel of the moving apparatus and a transmitting portion for transmitting a signal indicative of the sensed external conditions; and the electronic musical apparatus is provided with a generation mode controlling portion for receiving the signal transmitted from the transmitting portion and controlling, on the basis of the received signal, a mode in which the musical tone signal is generated by the musical tone signal generating portion in accordance with the sensed external conditions;

wherein the musical tone signal generating portion automatically generates a series of musical tone signals on the basis of a series of performance data, and the generation mode controlling portion changes a mode in which the series of musical tone signals are generated in accordance with the external conditions;

wherein the mode to be changed includes at least one of a tempo of automatic performance, a timing at which a musical tone signal is generated, and switching of the series of performance data.

17. A moving apparatus system having a moving apparatus which a human can ride to move and an electronic musical apparatus which is disposed apart from the moving apparatus and includes a musical tone signal generating portion for generating a musical tone signal, wherein:

the moving apparatus is provided with an external condition sensing portion for sensing external conditions in which the moving apparatus is placed and which vary with the travel of the moving apparatus and a transmitting portion for transmitting a signal indicative of the sensed external conditions; and the electronic musical apparatus is provided with a generation mode controlling portion for receiving the signal transmitted from the transmitting portion and controlling, on the basis of the received signal, a mode in which the musical tone signal is generated by the musical tone signal generating portion in accordance with the sensed external conditions;

wherein the generation mode controlling portion controls, on the basis of the sensed external conditions, a timing at which the musical tone signal generating portion generates the musical tone signal or a musical tone element of the musical tone signal generated by the musical tone signal generating portion.

18. A moving apparatus system according to claim 17, wherein the musical tone element includes at least one of a tone pitch of the musical tone signal, a tone color of the musical tone signal, loudness of the musical tone signal and an effect to be added to the musical tone signal.

19. A moving apparatus system according to claim 11, wherein the moving apparatus further includes a movement amount sensing portion for sensing the amount of movement indicative of the movement of the moving apparatus, and the generation mode controlling portion controls the mode in which the musical tone signal is generated by the musical tone signal generating portion in accordance with the sensed amount of the movement in addition to the sensed external conditions.

20. A moving apparatus system according to claim 19, wherein the amount of movement of the moving apparatus includes at least one of a steering angle, forward and backward acceleration, lateral acceleration, forward and backward speed, lateral speed, traveling direction, and angle speed of the moving apparatus.

* * * * *